US009790731B1

(12) United States Patent
Bishman et al.

(10) Patent No.: US 9,790,731 B1
(45) Date of Patent: Oct. 17, 2017

(54) FENESTRATION UNITS WITH SPACER BLOCKS AND METHODS OF MANUFACTURING THE SAME

(71) Applicant: ANDERSEN CORPORATION, Bayport, MN (US)

(72) Inventors: Corey Bishman, Cottage Grove, MN (US); Jeremiah Boe, Lino Lakes, MN (US); Duane Fier, Hudson, WI (US); Todd E. Dombrock, Newport, MN (US)

(73) Assignee: ANDERSEN CORPORATION, Bayport, MN (US)

( * ) Notice: Subject to any disclaimer, the term of this patent is extended or adjusted under 35 U.S.C. 154(b) by 116 days.

(21) Appl. No.: 14/974,122

(22) Filed: Dec. 18, 2015

Related U.S. Application Data

(60) Provisional application No. 62/094,249, filed on Dec. 19, 2014.

(51) Int. Cl.

| | |
|---|---|
| ***E06B 1/60*** | (2006.01) |
| ***E06B 1/36*** | (2006.01) |
| ***E06B 1/70*** | (2006.01) |
| ***E06B 1/68*** | (2006.01) |

(52) U.S. Cl.
CPC ..... *E06B 1/6069* (2013.01); *E06B 1/36* (2013.01); *E06B 1/60* (2013.01); *E06B 1/603* (2013.01); *E06B 1/6015* (2013.01); *E06B 1/68* (2013.01); *E06B 1/702* (2013.01)

(58) Field of Classification Search
CPC . E06B 1/6069; E06B 1/36; E06B 1/60; E06B 1/68; E06B 1/702; E06B 2001/628; E06B 1/6007; E06B 1/603; E06B 1/6046; E06B 1/04; E06B 1/6015; E06B 1/02; E06B 1/08
USPC ..... 52/126.1, 126.3, 217, 204.56, 204.64, 52/213, 745.2, 745.16, 204.55, 214, 52/204.591, 204.599, 208
See application file for complete search history.

(56) References Cited

U.S. PATENT DOCUMENTS 2,124,355 A * 7/1938 Plym ..... E06B 1/38 52/204.599
2,524,961 A * 10/1950 Cramer, Jr. ..... F01B 17/04 254/104
2,539,703 A * 1/1951 Sato ..... E04G 25/00 248/357
3,501,866 A * 3/1970 Johnson ..... E06B 7/2318 49/380
4,397,124 A 8/1983 Redman
4,512,125 A * 4/1985 Eriksson ..... E06B 3/5409 52/204.591
4,625,489 A * 12/1986 Bogle ..... E04F 13/0807 254/104
4,679,366 A * 7/1987 Hitchins ..... E04B 2/821 52/217
4,713,922 A * 12/1987 Ingold ..... E06B 1/6069 254/104

(Continued)

*Primary Examiner* — Robert Canfield
*Assistant Examiner* — Matthew Gitlin
(74) *Attorney, Agent, or Firm* — Mueting, Raasch & Gebhardt, P.A.

(57) ABSTRACT

Fenestration units with spacer blocks and methods of manufacturing the same are described herein. The fenestration units may include shim wedges that cooperate with the spacer blocks to raise the fenestration unit within a rough opening.

27 Claims, 30 Drawing Sheets

(56) References Cited

U.S. PATENT DOCUMENTS 4,731,965 A * 3/1988 Jensen ..... F16B 2/14 254/104
4,745,721 A 5/1988 Gartner
5,343,668 A * 9/1994 Gonzalez ..... E04G 21/24 16/87 R
5,655,342 A * 8/1997 Guillemet ..... E06B 1/60 49/505
5,655,343 A 8/1997 Seals
5,687,519 A * 11/1997 Bruchu ..... B29C 65/20 49/504
5,692,350 A * 12/1997 Murphy, Jr. ..... E06B 1/6084 411/533
5,815,992 A * 10/1998 Wells ..... F16B 19/02 248/188.2
6,018,916 A * 2/2000 Henry ..... E06B 1/6069 254/104
6,159,575 A * 12/2000 Rathsack ..... E06B 1/6069 428/119
6,182,405 B1 * 2/2001 Lindahl ..... E06B 1/003 52/202
6,216,402 B1 4/2001 Van de Laar
6,230,446 B1 * 5/2001 Chalich ..... E06B 1/6069 16/17.1
6,305,130 B1 10/2001 Ackerman, Jr.
6,385,925 B1 5/2002 Wark
6,560,934 B1 * 5/2003 Workman ..... F16M 7/00 248/188.2
6,826,878 B1 12/2004 Rovtar
7,490,442 B1 * 2/2009 Jackson ..... E04G 15/02 52/214
7,814,716 B2 * 10/2010 Moffatt ..... E06B 1/6015 204/213
7,987,637 B2 8/2011 Smith
8,117,789 B2 2/2012 Teodorovich
8,397,469 B2 * 3/2013 Temnyenkov ..... E06B 5/12 52/167.1
8,621,795 B2 * 1/2014 Peterson ..... E06B 1/60 52/204.55
8,695,293 B2 4/2014 Teodorovich
8,813,437 B1 * 8/2014 Spofford ..... E06B 1/6069 52/126.1
2003/0145531 A1 * 8/2003 Holder ..... E04F 13/0853 52/98
2005/0178079 A1 * 8/2005 Hardman ..... E06B 1/02 52/208
2010/0064607 A1 * 3/2010 Warunek ..... E06B 1/64 52/213
2011/0296777 A1 * 12/2011 Matta ..... E06B 1/342 52/208
2014/0093691 A1 * 4/2014 Shray ..... B29C 44/583 428/156

* cited by examiner

FENESTRATION UNITS WITH SPACER BLOCKS AND METHODS OF MANUFACTURING THE SAME

RELATED APPLICATION

This application claims the benefit under 35 U.S.C. Section 119 of U.S. Provisional Patent Application Ser. No. 62/094,249 entitled "FENESTRATION UNITS WITH SPACER BLOCKS AND METHODS OF MANUFACTURING THE SAME" and filed on Dec. 19, 2014, which is incorporated herein by reference in its entirety.

Fenestration units with spacer blocks and methods of manufacturing the same are described herein.

Fenestration units (such as, e.g., windows, doors, etc.) are typically mounted in frames that include a sill at the bottom of the opening in which the fenestration unit is located. The frame opening (commonly referred to as a rough opening) is typically slightly larger than the fenestration unit and the position of the fenestration unit is adjusted in the frame opening using shims. In particular, the height of the fenestration sill above the opening sill is adjusted to ensure that the fenestration unit is level in the rough opening. Typically, the spacer blocks are provided separately from the fenestration unit and placed in the proper locations around the fenestration frame during installation.

SUMMARY

Fenestration units with spacer blocks and methods of manufacturing the same are described herein.

Windows and other fenestration units are typically installed in rough openings of buildings in a position slightly elevated from the sill of the rough opening. The elevated positioning may provide an air gap that allows drying of any moisture that may find its way beneath the fenestration unit, due, for example, to leakage or condensation. A common method for determining the spacing between the bottom of the unit and the rough opening sill is to place spacers, in the form of blocks of the appropriate height, at the bottom corners of the rough opening. Placing the spacer blocks in the corners of fenestration units described herein may, in one or more embodiments, provide the additional advantage of supporting the fenestration unit at its vertical side jambs, thereby reduce the likelihood of bending of horizontal members of the fenestration unit due to, e.g., settling or deflection of the building structure. Placing spacer blocks beneath mull joints of mulled fenestration units as described herein may, in one or more embodiments, reduce the likelihood of bending of horizontal members of the fenestration unit due to, e.g., settling or deflection of the building structure and/or the weight of the mulled fenestration unit itself. Spacer block material is not particularly limited, although various plastics have been found to provide satisfactory combinations of dimensional stability, resistance to decay, and low cost.

In one or more embodiments of the fenestration units described herein, the spacer blocks are attached to the fenestration units at the time of manufacturing. Attaching the spacer blocks at the time of manufacturing may be helpful in ensuring proper placement of the spacer blocks on the fenestration units and, in one or more embodiments, may assist in protecting corners of fenestration units during shipping and handling. In other alternative embodiments, however, the spacer blocks and related components such as, e.g., shim wedges as described herein may be attached to the fenestration units at or close to the time of installation of the fenestration unit in a rough opening.

In one or more embodiments, the spacer blocks attached to fenestration units as described herein may include one or more ramp surfaces that may allow for easier installation of the fenestration units with reduced risk of header interference in rough openings and/or damage to flashing tape and other water management members provided in the rough openings.

In one or more embodiments, the spacer blocks used on fenestration units as described herein may provide increased area for drying and water drainage underneath the fenestration units.

In one or more embodiments, the spacer blocks described herein may be configured to receive and cooperate with leveling shims which can be wedge shaped to allow for adjustment of the location of a fenestration unit within a rough opening.

In a first aspect, one or more embodiments of the fenestration units described herein may include: a fenestration frame comprising a fenestration sill, a first side jamb, and a second side jamb, wherein the fenestration sill extends between a first end and a second end along a width axis of the fenestration frame, wherein the first side jamb extends upwards from the first end of the fenestration sill and the second side jamb extends upwards from the second end of the fenestration sill, and wherein the fenestration sill comprises an interior edge and an exterior edge with a depth axis of the fenestration frame extending between the interior and exterior edges, wherein the depth axis is transverse to the width axis; a first spacer block attached to the fenestration frame along a bottom of the fenestration sill at the first end of the fenestration sill, wherein the first spacer block is configured to be located between the bottom of the fenestration sill and a top surface of a rough opening sill in which the fenestration unit is located; and a second spacer block attached to the fenestration frame along a bottom of the fenestration sill at the second end of the fenestration sill, wherein the second spacer block is configured to be located between the bottom of the fenestration sill and the top surface of a rough opening sill in which the fenestration unit is located. The second spacer block comprises: a base comprising a sill surface facing the bottom of the fenestration sill; a bearing surface facing away from the bottom of the fenestration sill, wherein the bottom of the fenestration sill at the second end is supported (against the force of gravity) above a top surface of a rough opening sill by the bearing surface when the fenestration frame is located in a rough opening defined along one side by the rough opening sill; and a leading ramp surface extending from the bearing surface towards the interior edge of the fenestration sill, wherein the leading ramp surface defines a leading ramp surface height measured between the sill surface of the base and the leading ramp surface that decreases when moving along the depth axis from the bearing surface towards the interior edge of the fenestration sill.

In one or more embodiments of fenestration units as described herein, the bearing surface of the second spacer block is located a uniform distance from the sill surface of the base when moving along the direction of the depth axis.

In one or more embodiments of fenestration units as described herein, the leading ramp surface height of the leading ramp surface changes linearly when moving along the depth axis from the bearing surface towards the interior edge of the fenestration sill.

In one or more embodiments of fenestration units as described herein, the leading ramp surface height of the leading ramp surface changes at different rates when moving along the depth axis from the bearing surface towards the interior edge of the fenestration sill.

In one or more embodiments of fenestration units as described herein, the second spacer block comprises a trailing ramp surface extending from the bearing surface towards the exterior edge of the fenestration sill, wherein the trailing ramp surface defines a trailing ramp surface height measured between the sill surface of the base and the trailing ramp surface that decreases when moving along the depth axis from the bearing surface towards the exterior edge of the fenestration sill, and wherein the bearing surface is located between the leading ramp surface and the trailing ramp surface.

In one or more embodiments of fenestration units as described herein, the trailing ramp surface height of the trailing ramp surface changes linearly when moving along the depth axis from the bearing surface towards the exterior edge of the fenestration sill.

In one or more embodiments of fenestration units as described herein, the trailing ramp surface height of the trailing ramp surface changes at different rates when moving along the depth axis from the bearing surface towards the exterior edge of the fenestration sill.

In one or more embodiments of fenestration units as described herein, the second spacer block comprises: a support rib defining a support rib axis extending through the support rib, wherein the support rib axis is aligned with the width axis, wherein the rib axis extends through the bearing surface or between the bearing surface and the sill surface of the base of the second spacer block, wherein the support rib comprises a support rib height measured between the sill surface of the base and the support rib that is equal to or less than a bearing surface height of the bearing surface as measured between the sill surface of the base and the bearing surface; and an interior support rib ramp surface extending from the support rib towards the interior edge of the fenestration sill, wherein the interior support rib ramp surface defines an interior support rib ramp surface height measured between the sill surface of the base and the interior support rib ramp surface that decreases when moving along the depth axis from the support rib towards the interior edge of the fenestration sill.

In one or more embodiments of fenestration units as described herein, an exterior support rib ramp surface extends from the support rib towards the exterior edge of the fenestration sill, and wherein the exterior support rib ramp surface defines an exterior support ramp surface height measured between the sill surface of the base and the exterior support rib ramp surface that decreases when moving along the depth axis from the support rib towards the exterior edge of the fenestration sill.

In one or more embodiments of fenestration units as described herein, the bearing surface is a first bearing surface and the leading ramp surface is a first leading ramp surface, wherein the second spacer block comprises a second bearing surface and a second leading ramp surface, wherein the first bearing surface and the first leading ramp surface are spaced apart from the second bearing surface and the second leading ramp surface by a channel; wherein the second bearing surface faces away from the bottom of the fenestration sill, wherein the second leading ramp surface extends from the second bearing surface towards the interior edge of the fenestration sill, and wherein the second leading ramp surface defines a leading ramp surface height measured between the sill surface of the base and the second leading ramp surface that decreases when moving along the depth axis from the bearing surface towards the interior edge of the fenestration sill; and wherein the support rib and the interior support rib ramp are located in the channel.

In one or more embodiments of fenestration units as described herein, an exterior support rib ramp surface is located in the channel, wherein the exterior support rib ramp surface extends from the support rib towards the exterior edge of the fenestration sill, and wherein the exterior support rib ramp surface defines an exterior support ramp surface height measured between the sill surface of the base and the exterior support rib ramp surface that decreases when moving along the depth axis from the support rib towards the exterior edge of the fenestration sill.

In one or more embodiments of fenestration units as described herein, the support rib comprises a first support rib and the interior support rib ramp comprises a first interior support rib ramp, and wherein the second spacer block comprises: a second support rib located on the support rib axis defined by the first support rib, wherein the second support rib comprises a second support rib height measured between the sill surface of the base and the second support rib that is equal to or less than a bearing surface height of the bearing surface as measured between the sill surface of the base and the bearing surface; and a second interior support rib ramp surface extending from the second support rib towards the interior edge of the fenestration sill, wherein the second interior support rib ramp surface defines a second interior support rib ramp surface height measured between the sill surface of the base and the second interior support rib ramp surface that decreases when moving along the depth axis from the second support rib towards the interior edge of the fenestration sill; and wherein the bearing surface is located between the first support rib and the second support rib.

In one or more embodiments of fenestration units as described herein, the fenestration unit comprises a shim wedge that comprises: a shim wedge base comprising a wedge base surface configured to sit on the top surface of a rough opening sill in which the fenestration unit is located; a wedge ramp surface facing away from the wedge base surface, wherein the wedge ramp surface comprises wedge ramp surface height measured between the wedge base surface and the wedge ramp surface, wherein the wedge ramp surface height increases when moving along a length of the wedge ramp surface, wherein the length is measured in a direction transverse to the wedge ramp surface width; wherein the support rib is configured to rest on the wedge ramp surface when the shim wedge is located between the second spacer block and the top surface of a rough opening sill in which the fenestration unit is located.

In one or more embodiments of fenestration units as described herein, the fenestration unit comprises a shim wedge that comprises: a shim wedge base comprising a wedge base surface configured to sit on the top surface of a rough opening sill in which the fenestration unit is located; a wedge ramp surface facing away from the wedge base surface, wherein the wedge ramp surface comprises a wedge ramp surface width configured to fit in the channel between the first bearing surface and the second bearing surface, wherein the wedge ramp surface comprises wedge ramp surface height measured between the wedge base surface and the wedge ramp surface, and wherein the wedge ramp surface height increases when moving along a length of the wedge ramp surface, wherein the length is measured in a direction transverse to the wedge ramp surface width; wherein the support rib is configured to rest on the wedge ramp surface when the shim wedge is located between the second spacer block and the top surface of a rough opening sill in which the fenestration unit is located.

In one or more embodiments of fenestration units described herein, the wedge ramp surface comprises a plurality of detents spaced apart from each other along the length of the wedge ramp surface, wherein the plurality of detents are located at different wedge ramp surface heights.

In one or more embodiments of fenestration units described herein, the support rib defines an axis of rotation, and wherein the second spacer block and the shim wedge can rotate relative to each other about the axis of rotation such that the sill surface of the base of the second spacer block and the wedge base can be arranged in non-parallel orientations.

In one or more embodiments of fenestration units described herein, the shim wedge is attached to the fenestration unit.

In one or more embodiments of fenestration units described herein, the shim wedge is attached to the second spacer block.

In one or more embodiments of fenestration units described herein, the shim wedge is attached to the second spacer block by a tether.

In one or more embodiments of fenestration units described herein, the fenestration unit comprises a mull joint located at an intermediate position between the first end and the second end of the fenestration sill, and wherein a mull joint spacer block is attached to the fenestration frame along a bottom of the fenestration sill at the intermediate position, wherein the mull joint spacer block is configured to be located between the bottom of the fenestration sill and the top surface of a rough opening sill in which the fenestration unit is located, and wherein the mull joint spacer block comprises: a base comprising a sill surface facing the bottom of the fenestration sill; a bearing surface facing away from the bottom of the fenestration sill; a leading ramp surface extending from the bearing surface towards the interior edge of the fenestration sill, wherein the leading ramp surface defines a leading ramp surface height measured between the sill surface of the base and the leading ramp surface that decreases when moving along the depth axis from the bearing surface towards the interior edge of the fenestration sill.

In one or more embodiments of fenestration units described herein, the bearing surface of the mull joint spacer block is located a uniform distance from the sill surface of the base when moving along the direction of the depth axis.

In one or more embodiments of fenestration units described herein, the leading ramp surface height of the leading ramp surface changes linearly when moving along the depth axis from the bearing surface towards the interior edge of the fenestration sill.

In one or more embodiments of fenestration units described herein, the leading ramp surface height of the leading ramp surface changes at different rates when moving along the depth axis from the bearing surface towards the interior edge of the fenestration sill.

In one or more embodiments of fenestration units described herein, the mull joint spacer block comprises a trailing ramp surface extending from the bearing surface towards the exterior edge of the fenestration sill, wherein the trailing ramp surface defines a trailing ramp surface height measured between the sill surface of the base and the trailing ramp surface that decreases when moving along the depth axis from the bearing surface towards the exterior edge of the fenestration sill, and wherein the bearing surface is located between the leading ramp surface and the trailing ramp surface. In one or more embodiments, the trailing ramp surface height of the trailing ramp surface changes linearly when moving along the depth axis from the bearing surface towards the exterior edge of the fenestration sill. In one or more embodiments, the trailing ramp surface height of the trailing ramp surface changes at different rates when moving along the depth axis from the bearing surface towards the exterior edge of the fenestration sill.

In one or more embodiments of fenestration units described herein, the mull joint spacer block comprises: a support rib defining a support rib axis extending through the support rib, wherein the support rib axis is aligned with the width axis, wherein the rib axis extends through the bearing surface or between the bearing surface and the sill surface of the base of the mull joint spacer block, wherein the support rib comprises a support rib height measured between the sill surface of the base and the support rib that is equal to or less than a bearing surface height of the bearing surface as measured between the sill surface of the base and the bearing surface; and an interior support rib ramp surface extending from the support rib towards the interior edge of the fenestration sill, wherein the interior support rib ramp surface defines an interior support rib ramp surface height measured between the sill surface of the base and the interior support rib ramp surface that decreases when moving along the depth axis from the support rib towards the interior edge of the fenestration sill.

In one or more embodiments of fenestration units described herein, a mull joint spacer block may include an exterior support rib ramp surface extends from the support rib towards the exterior edge of the fenestration sill, and wherein the exterior support rib ramp surface defines an exterior support ramp surface height measured between the sill surface of the base and the exterior support rib ramp surface that decreases when moving along the depth axis from the support rib towards the exterior edge of the fenestration sill.

In one or more embodiments of fenestration units described herein, a mull joint spacer block as described herein, the bearing surface is a first bearing surface and the leading ramp surface is a first leading ramp surface, wherein the mull joint spacer block comprises a second bearing surface and a second leading ramp surface, wherein the first bearing surface and the first leading ramp surface are spaced apart from the second bearing surface and the second leading ramp surface by a channel; wherein the second bearing surface faces away from the bottom of the fenestration sill, wherein the second leading ramp surface extends from the second bearing surface towards the interior edge of the fenestration sill, and wherein the second leading ramp surface defines a leading ramp surface height measured between the sill surface of the base and the second leading ramp surface that decreases when moving along the depth axis from the bearing surface towards the interior edge of the fenestration sill; and wherein the support rib and the interior support rib ramp are located in the channel. In one or more embodiments, an exterior support rib ramp surface is located in the channel, wherein the exterior support rib ramp surface extends from the support rib towards the exterior edge of the fenestration sill, and wherein the exterior support rib ramp surface defines an exterior support ramp surface height measured between the sill surface of the base and the exterior support rib ramp surface that decreases when moving along the depth axis from the support rib towards the exterior edge of the fenestration sill.

In one or more embodiments of fenestration units described herein, the support rib of the mull joint spacer block comprises a first support rib and the interior support rib ramp comprises a first interior support rib ramp, and wherein the mull joint spacer block comprises: a second support rib located on the support rib axis defined by the first support rib, wherein the second support rib comprises a second support rib height measured between the sill surface of the base and the second support rib that is equal to or less than a bearing surface height of the bearing surface as measured between the sill surface of the base and the bearing surface; and a second interior support rib ramp surface extending from the second support rib towards the interior edge of the fenestration sill, wherein the second interior support rib ramp surface defines a second interior support rib ramp surface height measured between the sill surface of the base and the second interior support rib ramp surface that decreases when moving along the depth axis from the second support rib towards the interior edge of the fenestration sill; and wherein the bearing surface is located between the first support rib and the second support rib.

In one or more embodiments of fenestration units described herein including a mull joint spacer block, the fenestration unit comprises a mull joint shim wedge that comprises: a shim wedge base comprising a wedge base surface configured to sit on the top surface of a rough opening sill in which the fenestration unit is located; a wedge ramp surface facing away from the wedge base surface, wherein the wedge ramp surface comprises wedge ramp surface height measured between the wedge base surface and the wedge ramp surface, wherein the wedge ramp surface height increases when moving along a length of the wedge ramp surface, wherein the length is measured in a direction transverse to the wedge ramp surface width; wherein the support rib is configured to rest on the wedge ramp surface when the mull joint shim wedge is located between the mull joint spacer block and the top surface of a rough opening sill in which the fenestration unit is located.

In one or more embodiments of fenestration units described herein including a mull joint spacer block, the fenestration unit comprises a mull joint shim wedge that comprises: a shim wedge base comprising a wedge base surface configured to sit on the top surface of a rough opening sill in which the fenestration unit is located; a wedge ramp surface facing away from the wedge base surface, wherein the wedge ramp surface comprises a wedge ramp surface width configured to fit in the channel between the first bearing surface and the second bearing surface, wherein the wedge ramp surface comprises wedge ramp surface height measured between the wedge base surface and the wedge ramp surface, and wherein the wedge ramp surface height increases when moving along a length of the wedge ramp surface, wherein the length is measured in a direction transverse to the wedge ramp surface width; wherein the support rib is configured to rest on the wedge ramp surface when the mull joint shim wedge is located between the mull joint spacer block and the top surface of a rough opening sill in which the fenestration unit is located.

In one or more embodiments of fenestration units described herein including a mull joint spacer block and a mull joint shim wedge, the wedge ramp surface of the mull joint shim wedge comprises a plurality of detents spaced apart from each other along the length of the wedge ramp surface, wherein the plurality of detents are located at different wedge ramp surface heights.

In one or more embodiments of fenestration units described herein including a mull joint spacer block and a mull joint shim wedge, the support rib of the mull joint shim wedge defines an axis of rotation, and wherein the mull joint spacer block and the shim wedge can rotate relative to each other about the axis of rotation such that the sill surface of the base of the mull joint spacer block and the wedge base can be arranged in non-parallel orientations.

In one or more embodiments of fenestration units described herein including a mull joint spacer block and a mull joint shim wedge, the mull joint shim wedge is attached to the fenestration unit.

In one or more embodiments of fenestration units described herein including a mull joint spacer block and a mull joint shim wedge, the mull joint shim wedge is attached to the mull joint spacer block.

In one or more embodiments of fenestration units described herein including a mull joint spacer block and a mull joint shim wedge, the mull joint shim wedge is attached to the mull joint spacer block by a tether.

In one or more embodiments of fenestration units described herein, the second spacer block comprises a shim depth measured along the depth axis that is less than a depth of the fenestration sill as measured along the depth axis between the exterior edge and the interior edge of the fenestration sill.

In a second aspect, one or more embodiments of methods of manufacturing fenestration units as described herein may include: attaching the first spacer block to the fenestration frame along the bottom of the fenestration sill at the first end of the fenestration sill; and attaching the second spacer block attached to the fenestration frame along the bottom of the fenestration sill at the second end of the fenestration sill wherein the first and second spacer blocks are attached before the fenestration unit is installed in a rough opening in a building structure.

In one or more embodiments of methods of manufacturing fenestration units as described herein, the method further comprises attaching the shim wedge to the fenestration unit.

In one or more embodiments of methods of manufacturing fenestration units as described herein, the method further comprises attaching the mull joint spacer block along the bottom of the fenestration sill at the intermediate position of the fenestration sill before the fenestration unit is installed in a rough opening in a building structure.

In a third aspect, one or more embodiments of methods of manufacturing a fenestration unit as described herein may include attaching the first spacer block to the fenestration frame along the bottom of the fenestration sill at the first end of the fenestration sill; attaching the second spacer block attached to the fenestration frame along the bottom of the fenestration sill at the second end of the fenestration sill; and packaging the fenestration unit for delivery to a customer after attaching the first and second spacer blocks to the fenestration sill.

In one or more embodiments of methods of manufacturing fenestration units according to the third aspect, the method further comprises attaching the shim wedge to the fenestration unit.

In one or more embodiments of methods of manufacturing fenestration units according to the third aspect, the method further comprises attaching the mull joint spacer block along the bottom of the fenestration sill at the intermediate position of the fenestration sill before packaging the fenestration unit for delivery to a customer.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

Where used herein, the terms "top" and "bottom" are used for reference relative to each other when the fenestration units described herein are properly installed in a building opening.

Where used herein, the terms "exterior" and "interior" are used in a relative sense, e.g., an exterior edge and an interior edge of a sill or any other component describe edges located on opposite sides of the fenestration unit. In other words, an exterior edge could be found within the interior of a building or other structure that would conventionally define an interior and an exterior, while an interior edge could be found outside of a building or other structure that would conventionally define an interior and an exterior.

The above summary is not intended to describe each embodiment or every implementation of the fenestration units with spacer blocks and methods described herein. Rather, a more complete understanding of the invention will become apparent and appreciated by reference to the following Description of Illustrative Embodiments and claims in view of the accompanying figures of the drawing.

DESCRIPTION OF ILLUSTRATIVE EMBODIMENTS

Figure 1:
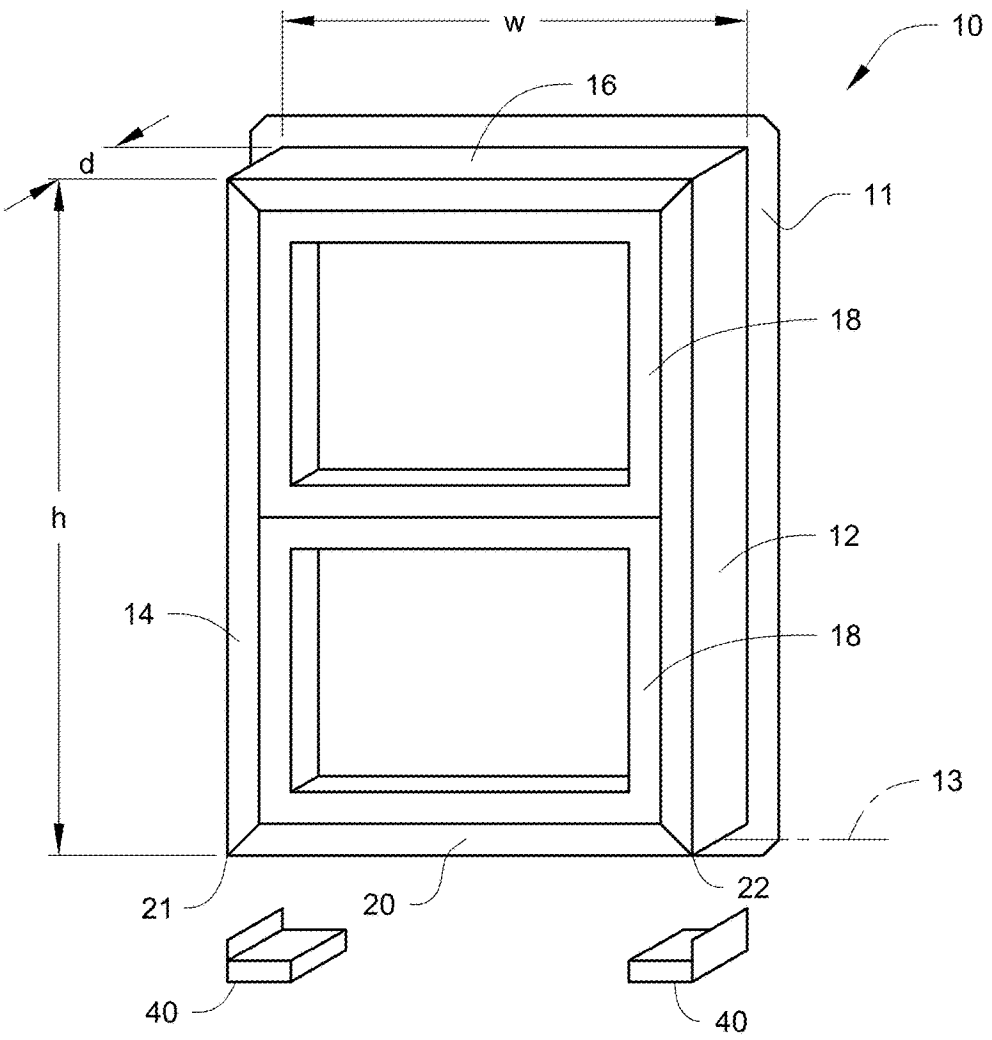
FIG. 1 depicts one illustrative embodiment of a fenestration unit including spacer blocks as described herein.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

One illustrative embodiment of a fenestration unit is depicted in FIG. 1. The fenestration unit 10 includes a frame that is formed by a fenestration sill 20, first side jamb 12, second side jamb 14, and head jamb 16 which, in combination, define an opening in the fenestration frame. The depicted illustrative embodiment of fenestration unit 10 also includes an optional mounting flange 11 that may be found on an exterior side of one or more embodiments of fenestration units and is used to assist with both attaching the fenestration unit within a rough opening and also limiting entry of water around the perimeter of the fenestration unit 10. The fenestration sill 20 extends from a first end 21 to a second end 22, with the fenestration sill 20 defining a width axis 13 for the fenestration unit 10 along its length. The depicted illustrative embodiment of fenestration unit 10 includes spacer blocks 40 mounted on the first end 21 and the second end 22 of the fenestration sill 20.

Spacer blocks as described herein may also be provided at other locations on the fenestration unit if needed. For example, in one or more alternative embodiments, a fenestration unit may be in the form of a mulled fenestration unit that includes two or more fenestration units connected to each other along one or more mull joints. Mulled fenestration units may, in one or more embodiments, include additional spacer blocks to adequately support the combined fenestration units (e.g., one or more spacer blocks may be positioned to support the mulled fenestration unit at its mull joint(s)).

Figure 2:
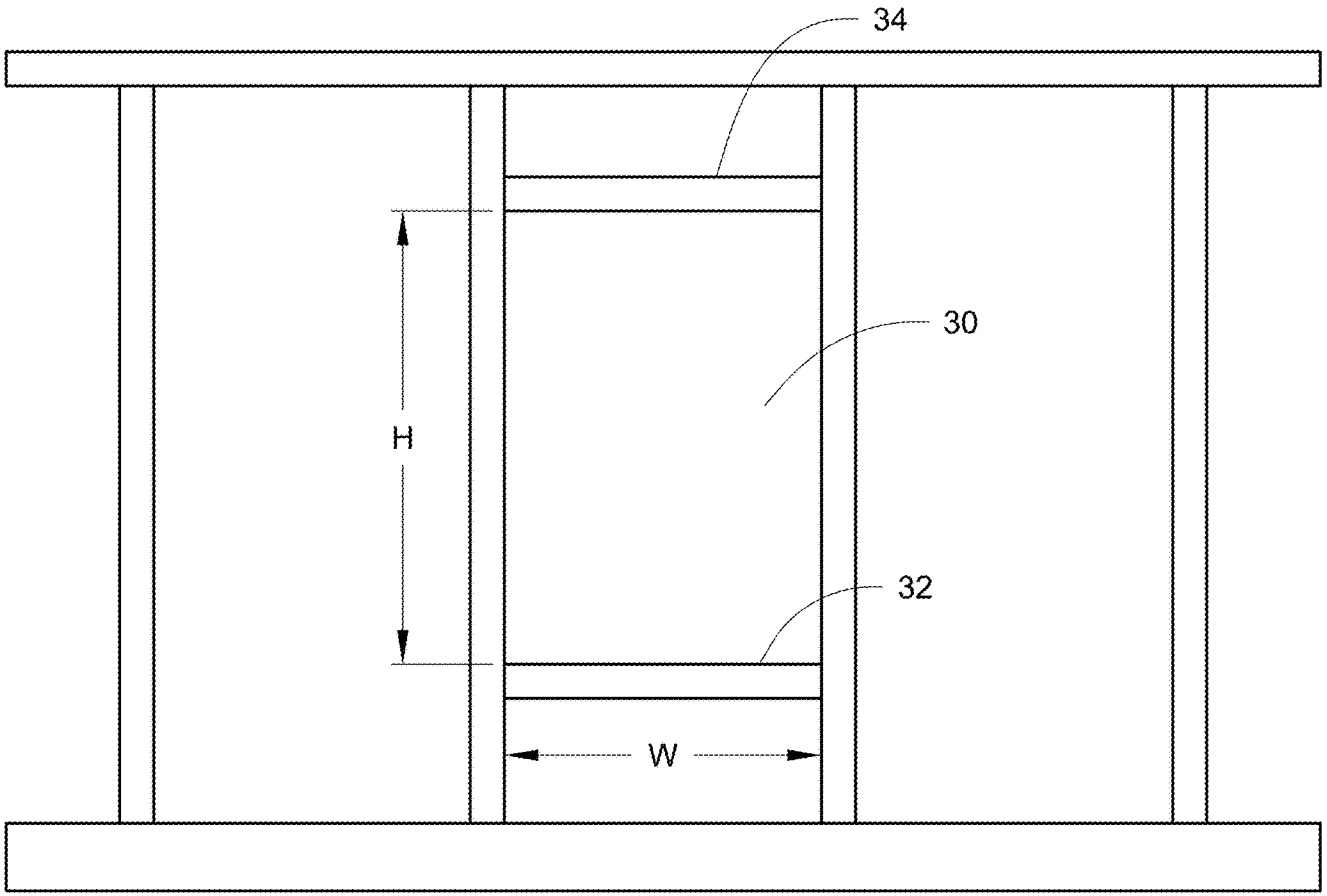
FIG. 2 is a diagram of a rough opening in a wall in which the fenestration unit of FIG. 1 may be installed.

Also shown in FIG. 1 are dimensions w designating the width of the fenestration unit, h designating the height of the fenestration unit, and d designating the depth of the fenestration unit (typically measured transverse to both the width and the height of the fenestration unit. As used herein, lower case letters will designate the width, height, and depth dimensions on the fenestration unit, and upper case letters will designate dimensions on the opening in which the fenestration unit is installed (see, e.g., FIG. 2).

The frame opening defined within the frame members of the fenestration units described herein may, in one or more embodiments, include one or more panels, such as, e.g., panels 18 mounted within the opening in the fenestration unit 10. One or more of the panels 18 may be mounted for movement relative to the frame members defining the opening such that the one or more panels 18 can be moved to close or open at least a portion of the opening to, e.g., allow traffic and/or air to pass through the opening. In one or more embodiments, one or more of the panels 18 may be fixed in position relative to the frame members defining the opening. In one or more embodiments, the panels 18 may be in the form of a door panel, window sash, etc. and the movable panels may be mounted for sliding movement, rotational movement, and/or combinations thereof relative the frame members of the fenestration unit 10.

Although the frame members of the depicted illustrative embodiment of fenestration unit 10 form a rectangular fenestration unit, fenestration units as described herein may take a variety of shapes. One common feature of the variety of fenestration units described herein, however, is the fenestration sill 20 with a first side jamb 12 extending upward from the first end 21 of the fenestration sill 20 and a second side jamb 14 extending upward from the second end 22 of the fenestration sill 20. Although the side jambs 12 and 14 form a right angle with the fenestration sill 20, such an arrangement is not required for all of the fenestration units described herein. One or more illustrative embodiments of non-rectangular fenestration units may include, e.g., fenestration units with round tops and rectangular bottom portions, fenestration units combining other circular and rectangular shapes, triangular fenestration units, pentagonal fenestration units, octagonal fenestration units, etc.

The fenestration units described herein are installed into openings in building structures, with the openings commonly referred to as a rough openings. One illustrative embodiment of a rough opening is diagrammatically depicted in FIG. 2, with the rough opening 30 having a height H typically measured along a generally vertical direction (where vertical is aligned with the direction of gravitational force) and width W measured generally transverse to the vertical direction. The rough opening 30 includes a rough opening sill 32 located along the bottom of the rough opening 30 and, in one or more embodiments, a rough opening header 34 located along a top of the rough opening. The rough opening sill 32 is typically, although not necessarily, oriented horizontally across the bottom of the rough opening 30. Rough opening width W and height H are typically made somewhat larger than their counterpart fenestration unit dimensions w and h to provide for a space between the periphery of the fenestration unit and the rough opening.

In one or more embodiments, the rough opening sill 32 may include a sill pan or other structure/material designed to drain water in a preferred direction (typically to the exterior of wall in which the rough opening 30 is located). For the purposes of the fenestration units described herein, the top surface of the rough opening sills will be that surface on which the spacer blocks on the fenestration sills of fenestration units rest when the fenestration units are installed in a rough opening with the weight of the fenestration unit being at least partially supported by the rough opening sill. In one or more embodiments, an additional amount may be added to height H of the rough opening to compensate for the thickness of, e.g., sill pans, flashing tape, or other members that may be added to the top of the structural member forming the rough opening sill 32 before the fenestration unit is located therein.

Figure 3B:
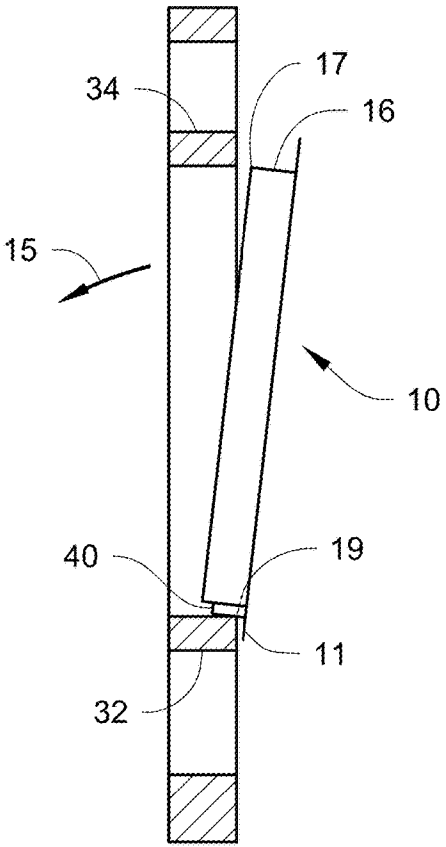
FIGS. 3A and 3B depict of one illustrative embodiment of a method of installing the fenestration unit of FIG. 1 into a rough opening in a wall.
Figure 3A:
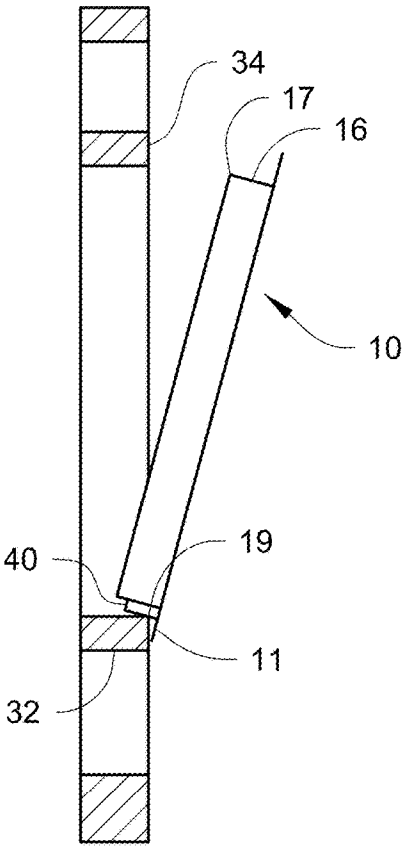

One illustrative embodiment of a method of mounting a fenestration unit 10 within rough opening 30 is depicted in FIGS. 3A and 3B. In the depicted method, one or both of the spacer blocks 40 on the fenestration sill 20 rest on the top surface of the rough opening sill 32 while the fenestration unit 10 is rotated into position (as indicated by arrow 15 in FIG. 3B) within the rough opening 30. In one or more embodiments, the position of the fenestration unit 10 in the rough opening 30 may be, at least in part, determined by a flange 11 found on an exterior side of the fenestration unit 10.

Referring to FIG. 3A, fenestration unit 10 is tilted to allow the bottom of the fenestration unit 10 to first enter the rough opening as far as flange 11 will allow. The unit is then allowed to rest the on sill 32, with the spacer blocks contacting sill 32 at points 19. The fenestration unit 10 is then rotated into the rough opening in the direction of arrow 15 as shown in FIG. 3B. The top leading edge 17 of fenestration unit 10 is in a slightly elevated position as the fenestration unit 10 is rotated into position, compared to when it is vertical.

For this reason, it is expected that header 34 will be positioned in a suitably elevated position, so that height H may, in one or more embodiments, be suitably increased, to compensate for this added height. Several factors may contribute to insufficient height H. In some cases, the building plans could be in error, due, for example, a failure to consider the thickness of sill pans or flashing tape. In other cases, sill 32 and header 34 may not be installed with the necessary precision. In yet other cases, a height specification may not be readily available, and height H is determined by measuring the unit and adding a clearance value that seems reasonable. Many other factors may be present to contribute to low values of H, and combinations of factors may also be present.

Figure 4A:
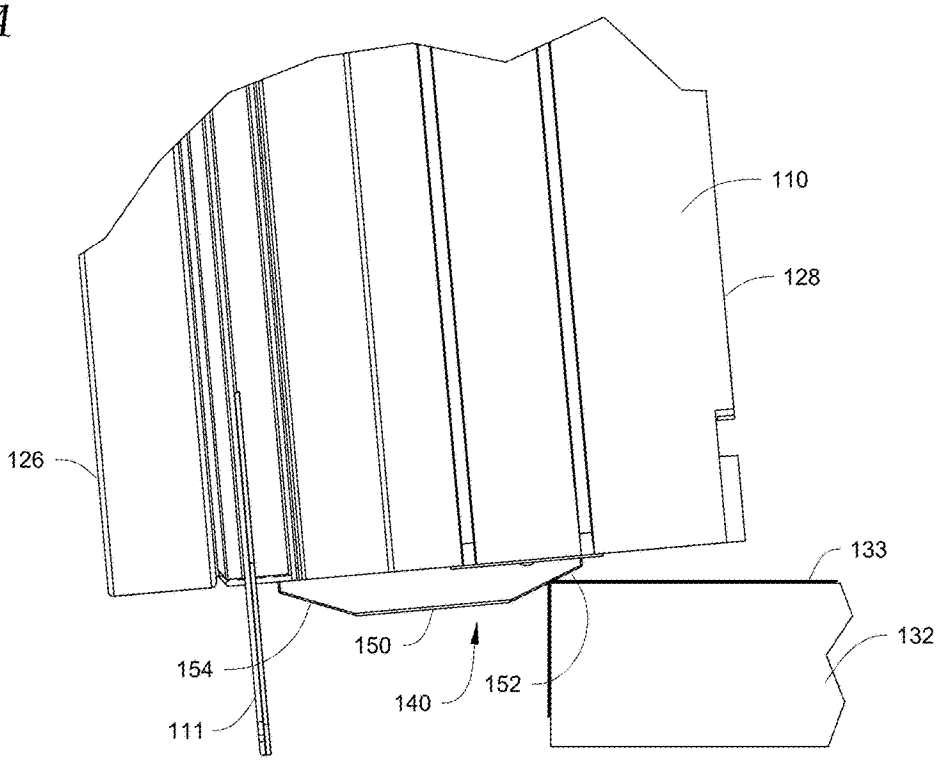
FIGS. 4A and 4B depict to illustrative embodiments of methods of installing a fenestration unit including one or more embodiments of spacer blocks as described herein in a rough opening.
Figure 4B:
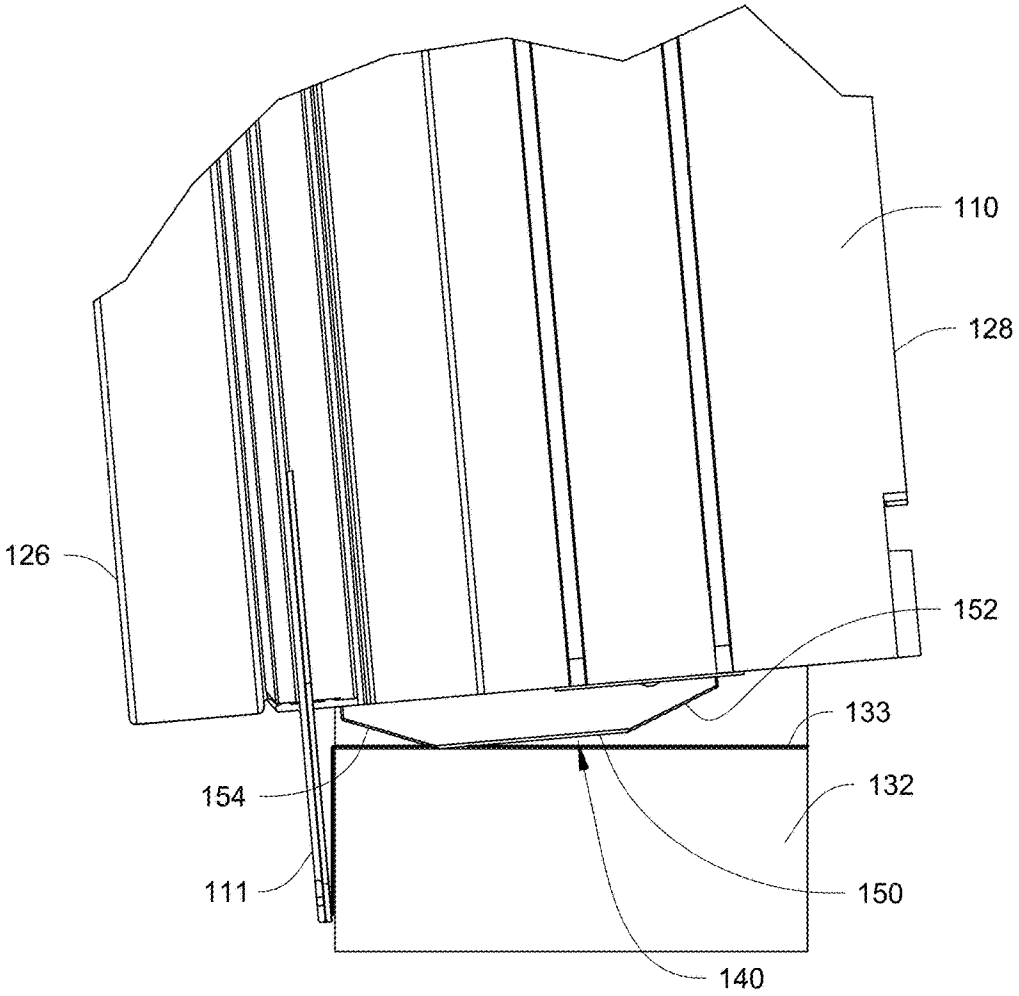
Figure 4C:
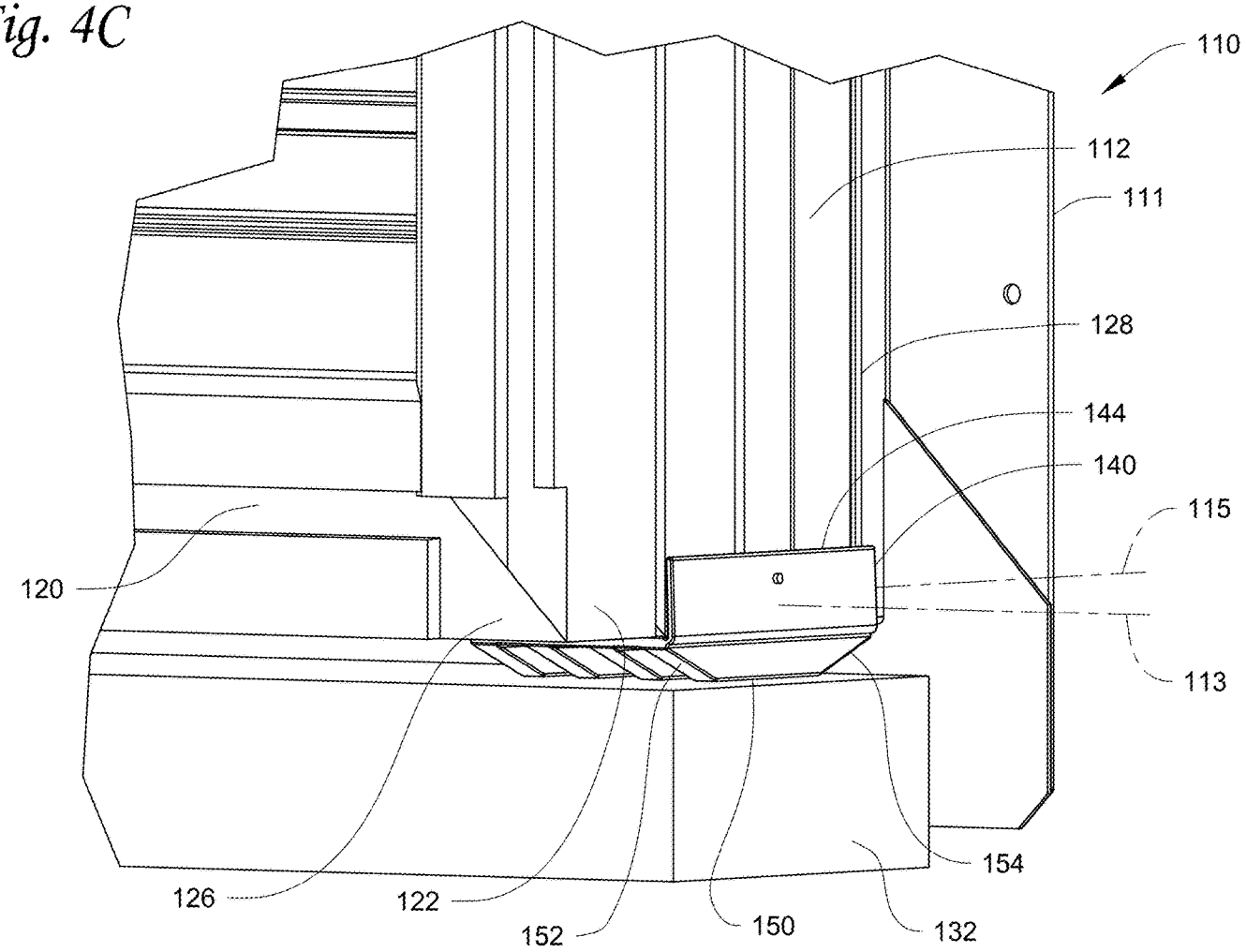
FIG. 4C is a perspective view of the fenestration units of FIGS. 4A and 4B after installation in a rough opening.

In one or more embodiments, however, rough opening height errors may be addressed by fenestration units using the spacer blocks as described herein. Referring to FIGS. 4A-4C, spacer blocks 140 may be attached to the bottom corners of fenestration unit 110, include ramps 152 and 154 along with a bearing surface 150 which rests on the top surface of the rough opening sill 132 when the fenestration unit 110 is fully installed as depicted in FIG. 4C. In one or more embodiments, bearing surface 150 may be flat to improve weight distribution, but bearing surfaces with other shapes may be suitable in other instances.

In one or more embodiments, one or both of the junctions between ramps 152 and 154 and bearing surface 150 may be in the form of a smooth transition that is, e.g., curved, radiused, rounded, etc. to reduce the risk of damage to flashing tape 133 located on rough opening sill 132 below the fenestration unit 110 if the installation process involves sliding the spacer block 140 along the top surface of the rough opening sill 132.

One illustrative embodiment of a method of installing a fenestration unit including spacer blocks is depicted in FIG. 4A. In the depicted method, the spacer block 140 may provide an opportunity to reduce the height of the fenestration unit 110 within the rough opening. In particular, leading ramp 152 is, in one or more embodiments, first rested on sill 132, after which fenestration unit 110 is slid into place on the rough opening sill 132 using leading ramp 152. Because leading ramp 152 allows the fenestration unit 110 to be in a somewhat lower position as it enters the rough opening, greater tilt angles and lower values of rough opening height H can be tolerated in one or more embodiments, thus allowing ergonomically easier installation and greater tolerance in height H.

Referring to FIG. 4B, another illustrative embodiment of a method of installation is depicted in which trailing ramp 154 also allows fenestration unit 110 to enter the rough opening at a lower height. In this method, fenestration unit 110 may be slightly raised while it is tilted back and inserted into the rough opening until flange 111 contacts the exterior wall, thereby stopping further travel. The fenestration unit 110 is then rotated or tilted upright (see, e.g., FIG. 3B) and moved into its installed position. In one or more embodiments, trailing ramp 154 may move the point about which the fenestration unit 110 pivots inward, thereby lowering the height of fenestration unit 110 by distance c, as shown in FIG. 4B.

By potentially reducing the effort that might be needed to maneuver a fenestration unit into a rough opening having slightly inadequate height, many ergonomic aspects of fenestration unit installation may be improved when installing one or more embodiments of fenestration units having spacer blocks as described herein. In one or more embodiments, one potential additional benefit is that, since the unit is more likely to be positioned and tilted into place properly on the first attempt without removal and repositioning, the risk of damage to sill flashing tape 133 and possible resulting water leakage may also be reduced.

Figure 5:
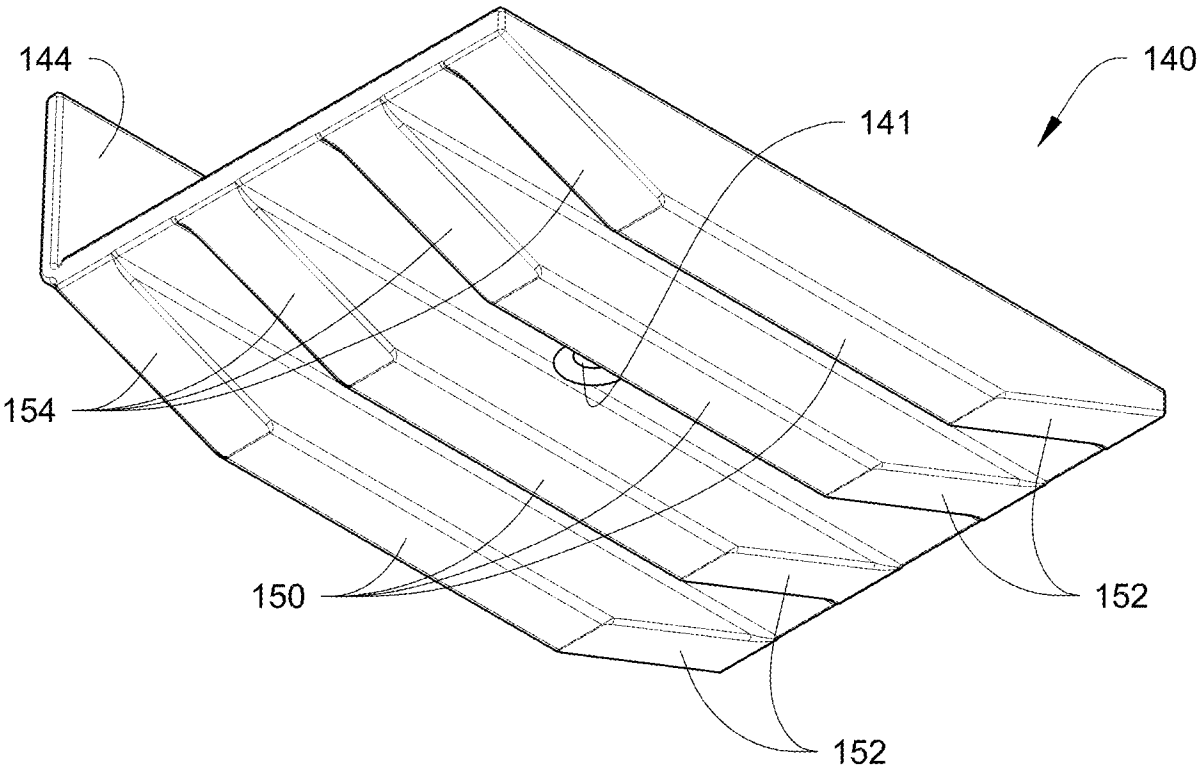
FIG. 5 is a bottom perspective view of the spacer block of FIG. 4C removed from the fenestration unit.
Figure 6:
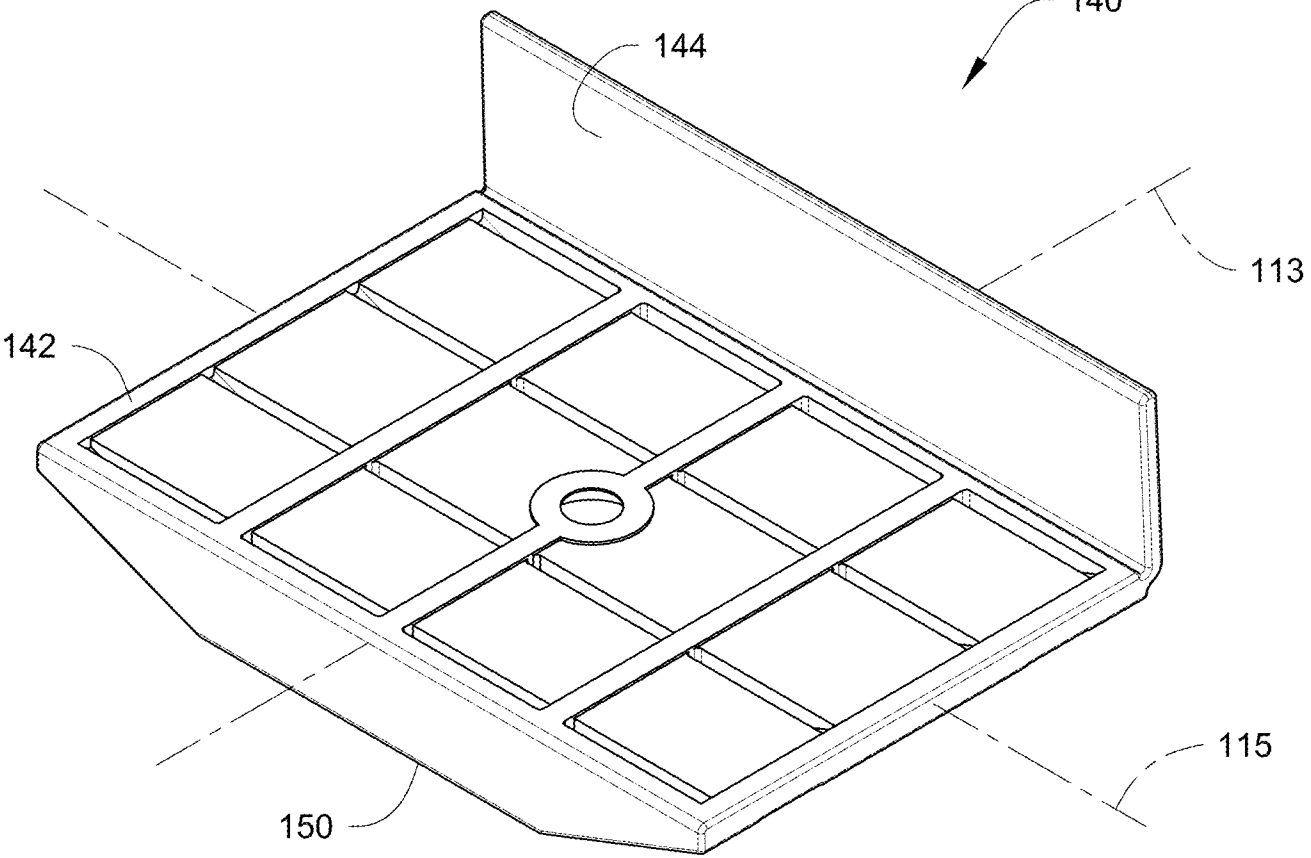
FIG. 6 is a top perspective view of the spacer block of FIG. 4C removed from the fenestration unit.
Figure 7:
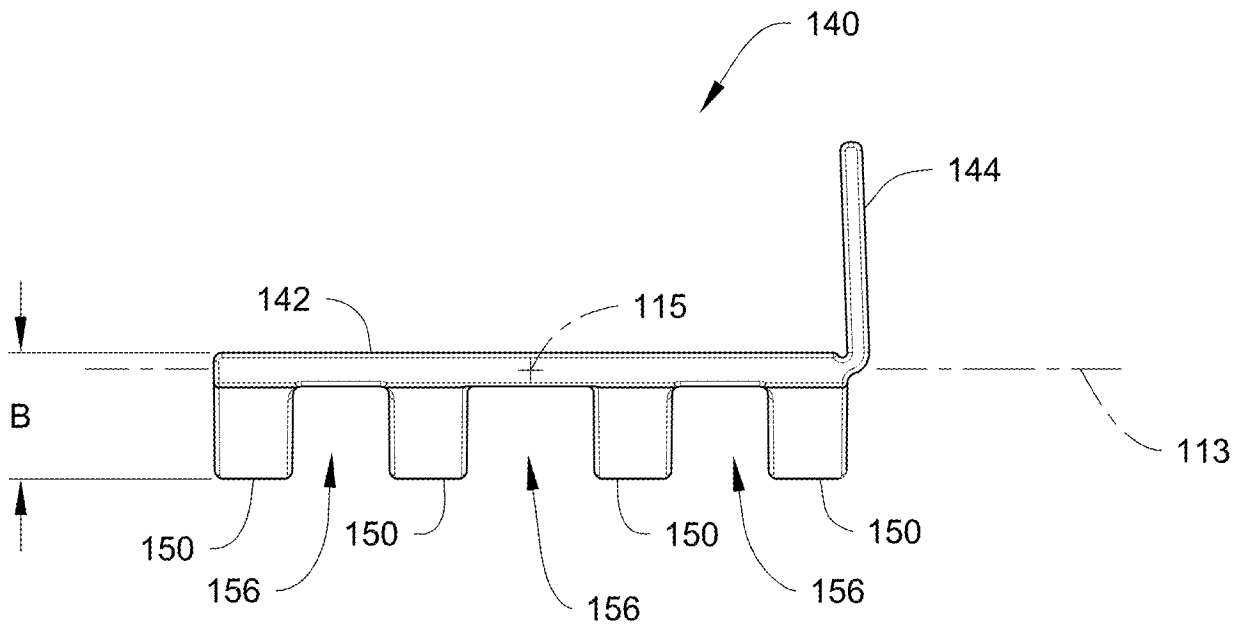
FIG. 7 is an end view of the spacer block of FIGS. 4C-6 when viewed along depth axis 115.
Figure 8:
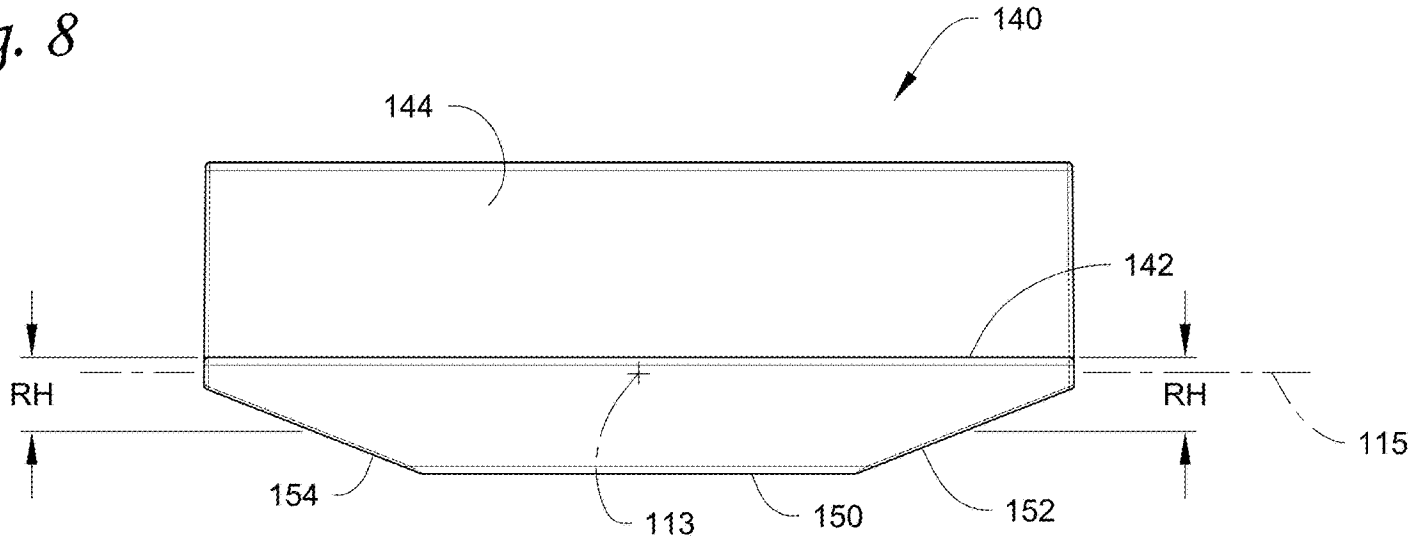
FIG. 8 is a side view of the spacer block of FIGS. 4C-6 when viewed along the width axis 113.

As noted above, FIG. 4C depicts, in a perspective view, the corner of one illustrative embodiment of a fenestration unit 110 with a spacer block 140 as described herein resting on the top surface of a rough opening sill 132. Additional features of one or more embodiments of a spacer block as described herein such as spacer block 140 are depicted in FIGS. 5-8. FIG. 5 is a perspective view showing the bottom surface of the spacer block 140, FIG. 6 is a perspective view showing the top of the spacer block 140, FIG. 7 is an end view of the spacer block 140 taken along the depth axis 115, and FIG. 8 is a side view of the spacer block 140 taken along the width axis 113. Although only one spacer block 140 is shown on one end 122 of the fenestration sill 120, it will be understood that a second spacer block is similarly located at the opposite end of the fenestration sill 120 (with, e.g., reference to the spacer blocks 40 depicted in FIG. 1).

The fenestration unit 110 includes a fenestration sill 120 with the spacer block 140 attached to the end 122 of the fenestration sill 120. In one or more embodiments, the spacer block 140 may be described as being attached to the fenestration frame along a bottom of the fenestration sill 120 at the end 122 of the fenestration sill 120. As a result, the spacer block 140 may be described as being configured to be located between the bottom of the fenestration sill 120 and a top surface of a rough opening sill 132 in which the fenestration unit 110 is located.

As discussed above in connection with the illustrative embodiment of fenestration unit 10 depicted in FIG. 1, the fenestration sill 120 defines a width axis 113 that extends along the length of the fenestration sill 120. The view of fenestration unit 110 in FIG. 4C also depicts the interior edge 126 and the exterior edge 128 of the fenestration sill 120. As seen in the depicted embodiment of fenestration unit 110, the exterior edge 128 of the fenestration sill 120 is located proximate the optional flange 111 on the fenestration unit 110. Also depicted in FIG. 4C is a depth axis 115 that extends between the interior edge 126 and the exterior edge 128 of the fenestration sill 120. In one or more embodiments, the depth axis 115 may be transverse to the width axis 113 defined by the fenestration sill 120. In one or more embodiments, the fenestration sill 120 may be described as having a depth measured between the interior edge 126 and the exterior edge 128 along the depth axis 115.

The illustrative embodiment of spacer block 140 as depicted in FIGS. 4C-6 includes a base having a sill surface 142 that faces the bottom 124 of the fenestration sill 120. In one or more embodiments, an attachment flange 144 may be attached to the base of the spacer block 140 and be, in one or more embodiments, oriented orthogonal to the sill surface 142 of the base of the spacer block 140. As seen in, e.g., FIG. 4C, the attachment flange 144 may extend upward along the side jamb 112 when the spacer block 140 is attached to the fenestration unit 110 with the sill surface 142 facing the bottom 124 of the fenestration sill 120. The attachment flange 144 may, in one or more embodiments, assist in accurate placement of the spacer block 140 on the end 121 of the fenestration sill 120 of the fenestration unit 110. The attachment flange 144 may also, in one or more embodiments, provide an additional location that may be used to attach the spacer block 140 to the fenestration unit 110. For example, in one or more embodiments, the attachment flange 144 may be attached to the side jamb 112 using one or of mechanical fasteners (e.g., threaded fasteners, nails, brads, staples, etc.), adhesives, etc. The attachment flange 144 is, however, optional and may not be found in all embodiments of the spacer blocks used in fenestration units as described herein.

As described herein, in one or more embodiments, the base of the spacer block 140 may be attached to the bottom of the fenestration sill 120 such that the sill surface 142 of the spacer block 140 faces the bottom of the fenestration sill 120. In one or more embodiments, the spacer block 140 may be attached to the fenestration sill 120 using the base of the spacer block 140 which may be attached to the fenestration sill 120 using one or more of mechanical fasteners (e.g., threaded fasteners, nails, brads, staples, etc.), adhesives, etc. In the depicted embodiment, the spacer block 140 includes an optional aperture 141 through which a threaded fastener or nail may be driven to attach the spacer block 140 to the fenestration sill 120.

In one or more embodiments, the spacer block 140 may include one or more bearing surfaces 150, each of which faces away from the bottom of the fenestration sill 120 and, therefore, towards the top surface of the rough opening sill 132 when the spacer block 140 is used to space a fenestration unit within a rough opening as described herein. In one or more embodiments, the bottom of the fenestration sill 120 at the end 122 is supported against the force of gravity above the top surface of the rough opening sill 132 by the bearing surfaces 150 when the fenestration unit 110 is located in a rough opening defined along one side by the rough opening sill 132. Providing a spacer block 140 having multiple bearing surfaces 150 with channels located between adjacent pairs of bearing surfaces 150 rather than a spacer block having only one continuous bearing surface may, in one or more embodiments, facilitate drying of moisture located on the top surface of the rough opening sill 132 below the fenestration unit 110. Drying may be facilitated by multiple bearing surfaces 150 separated by channels because the distance that moisture trapped between bearing surfaces 150 and sill 132 must diffuse in order to escape is reduced as compared to a single continuous bearing surface having a surface area similar to the sum of the surface areas of the multiple bearing surfaces 150.

In one or more embodiments such as the illustrative embodiment depicted in FIGS. 4C-8, the spacer block 140 may include one or more leading ramp surfaces 152 in addition to the bearing surfaces 150. Like the bearing surfaces 150, the leading ramp surfaces 152 also face away from the bottom of the fenestration sill 120. The leading ramp surfaces 152 of spacer blocks 140 as described herein extend from their respective bearing surface 150 towards the interior edge 126 of the fenestration sill 120. The leading ramp surfaces 152 define, in one or more embodiments, a leading ramp surface height (see, e.g., RH in FIG. 8) measured between the seal surface 142 of the base of the spacer block 140 and the leading ramp surface 152 that decreases when moving along the depth axis 115 from the bearing surface 150 associated with the ramp surface 152 towards the interior edge 126 of the fenestration sill 120.

Figure 9:
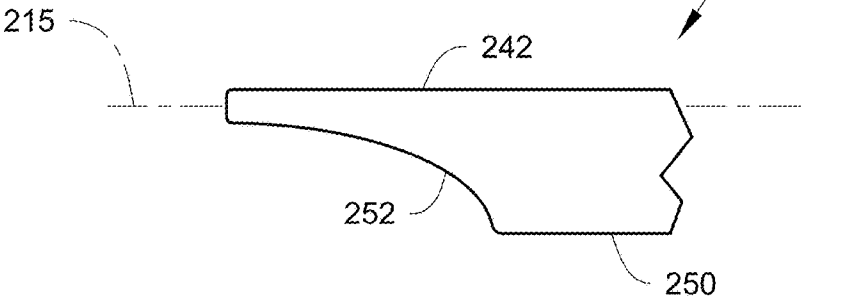
FIG. 9 depicts one illustrative alternative embodiment of ramp surface profile that may be used in the spacer blocks described herein.

In one or more embodiments such as in the illustrative embodiment of spacer block 140, the leading ramp surface height (RH) changes linearly when moving along the depth axis 115 from the bearing surface towards the interior edge 126 of the fenestration sill 120. In one or more alternative embodiments of spacer blocks that may be used with the fenestration units described herein, the leading ramp surface height may change at different rates when moving along the depth axis from the bearing surface towards the interior edge of the fenestration sill. One illustrative embodiment of such a construction is depicted in, e.g., FIG. 9, where the leading ramp surface 252 of the spacer block 240 has a leading ramp surface height relative to the sill surface 242 that changes at a decreasing rate when moving along the depth axis 215 away from the bearing surface 250. Although the alternative profiles of the leading ramp surfaces 150 and 252 are either straight or curved lines (which may, in one or more embodiments, have a reduced likelihood of damaging or displacing flashing tape or other material within a rough opening), it will be understood that in still other alternative embodiments of spacer blocks as described herein, the leading ramp surfaces may be provided with any other profile suitable for use in connection with the spacer blocks as described herein.

The one or more bearing surfaces 150 of spacer blocks as described herein may, in one or more embodiments, be in the form of a generally flat surface that is generally parallel to the bottom surface of the fenestration sill 120. In one or more embodiments, the one or more bearing surfaces 150 may be described as being located a uniform distance from the sill surface 142 of the base of the spacer block 140 when moving along the depth axis 115. The distance between the bearing surfaces 150 and the sill surface 142 may, in one or more embodiments, be described as a bearing surface height (see, e.g., B in FIG. 7).

In one or more embodiments of spacer blocks as described herein in which multiple bearing surfaces 150 and corresponding leading ramp surfaces 152 are provided, the bearing surfaces 150 and corresponding leading ramp surfaces 152 may be separated by channels 156 as depicted in, e.g., FIG. 7. The channels 156 located between bearing surfaces 150 and ramp surfaces 152 may allow for the passage of fluids such as, e.g., water, etc. from the interior edge 126 of the fenestration sill 120 towards the exterior edge 128 of the fenestration sill 120. Although the illustrative embodiment of spacer block 140 includes four bearing surfaces 150 and corresponding leading ramp surfaces 152, it should be understood that spacer blocks as described herein may include as few as one bearing surface and a corresponding leading ramp surface or any number of bearing surfaces and corresponding leading ramp surfaces (e.g., two, three, five, etc.).

Regardless of the number of bearing surfaces provided on spacer blocks as described herein, the number and size of the bearing surfaces may, in one or more embodiments, be selected based on the weight of the fenestration unit to be supported by the spacer block. In particular, the bearing surfaces distribute the weight of the fenestration unit on the top surface of the rough opening sill and concentrated forces that could be provided by fewer and/or smaller bearing surfaces may be more likely to damage flashing tape or other moisture control materials located in a rough opening. Similarly, it may be preferable to, in one or more embodiments, limit sharp edges or transitions along the sides of any bearing surfaces (as well as at the junctions between bearing surfaces and ramps as described herein).

In one or more embodiments of spacer blocks used on fenestration units as described herein, a trailing ramp surface may be used in addition to the leading ramp surface for one or more of the bearing surfaces. As depicted in, e.g., FIGS. 4A-4C, the illustrative embodiment of spacer block 140 includes trailing ramp surfaces 154 that extend from the bearing surfaces 150 towards the exterior edge 128 of the fenestration sill 120. Each of the trailing ramp surfaces 154 defines a trailing ramp surface height (see, e.g., RH in FIG. 8) measured between the sill surface 142 of the base of the spacer block 140 and the trailing ramp surface 154 with the trailing ramp surface height decreasing when moving along the depth axis 115 from the bearing surface 150 towards the exterior edge 128 of the fenestration sill 120. In those embodiments in which both a leading ramp surface 152 and a trailing ramp surface 154 are provided, the bearing surface 150 may be described as being located between the leading ramp surface 152 and the trailing ramp surface 154.

In one or more embodiments such as in the illustrative embodiment of spacer block 140, the trailing ramp surface height (RH) changes linearly when moving along the depth axis 115 from the bearing surface towards the exterior edge 128 of the fenestration sill 120. In one or more alternative embodiments of spacer blocks that may be used with the fenestration units described herein, the trailing ramp surface height may change at different rates when moving along the depth axis from the bearing surface towards the exterior edge of the fenestration sill. The discussion provided above with respect to various profiles and variations used in connection with the leading ramp surfaces apply equally to the trailing ramp surfaces of spacer blocks as described herein.

One potential advantage of spacer blocks used in fenestration units as described herein that include both leading ramp surfaces and trailing ramp surfaces in addition to bearing surfaces is that the spacer blocks may be used on both the right and left sides of a fenestration unit without limitation as opposed to embodiments in which only one ramp surface is provided in connection with a bearing surface. In those embodiments in which both leading and trailing ramp surfaces are provided, the spacer blocks may be used on either the right or left side of a fenestration unit with the leading and trailing ramp surfaces being defined by the side on which the spacer block is located, i.e., on one side a ramp surface would be in the position of a leading ramp surface while on the opposite side the same ramp surface would be in the position of a trailing ramp surface and vice versa.

Although the illustrative embodiment of spacer block 140 is depicted as being used alone in, e.g., FIG. 4C, it should be understood that conventional shims may be needed to selectively increase the height of the fenestration sill 120 above the rough opening sill 132 in, e.g., those installations in which the rough opening sill 132 is not level across its width W and it is desired to install the fenestration unit 110 with its fenestration sill 120 being level across its width w.

Figure 10:
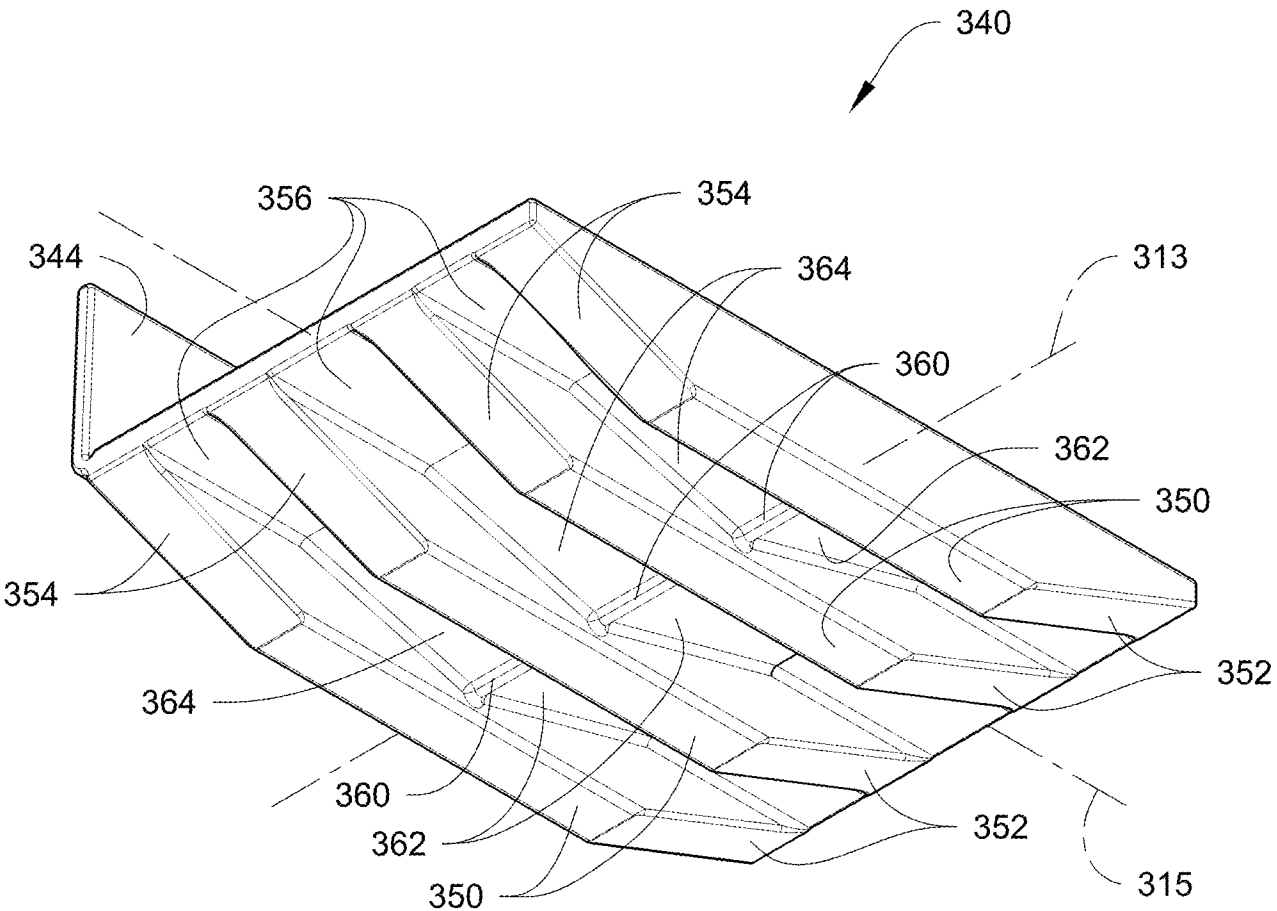
FIG. 10 is a bottom perspective view of another illustrative embodiment of a spacer block as described herein.
Figure 11:
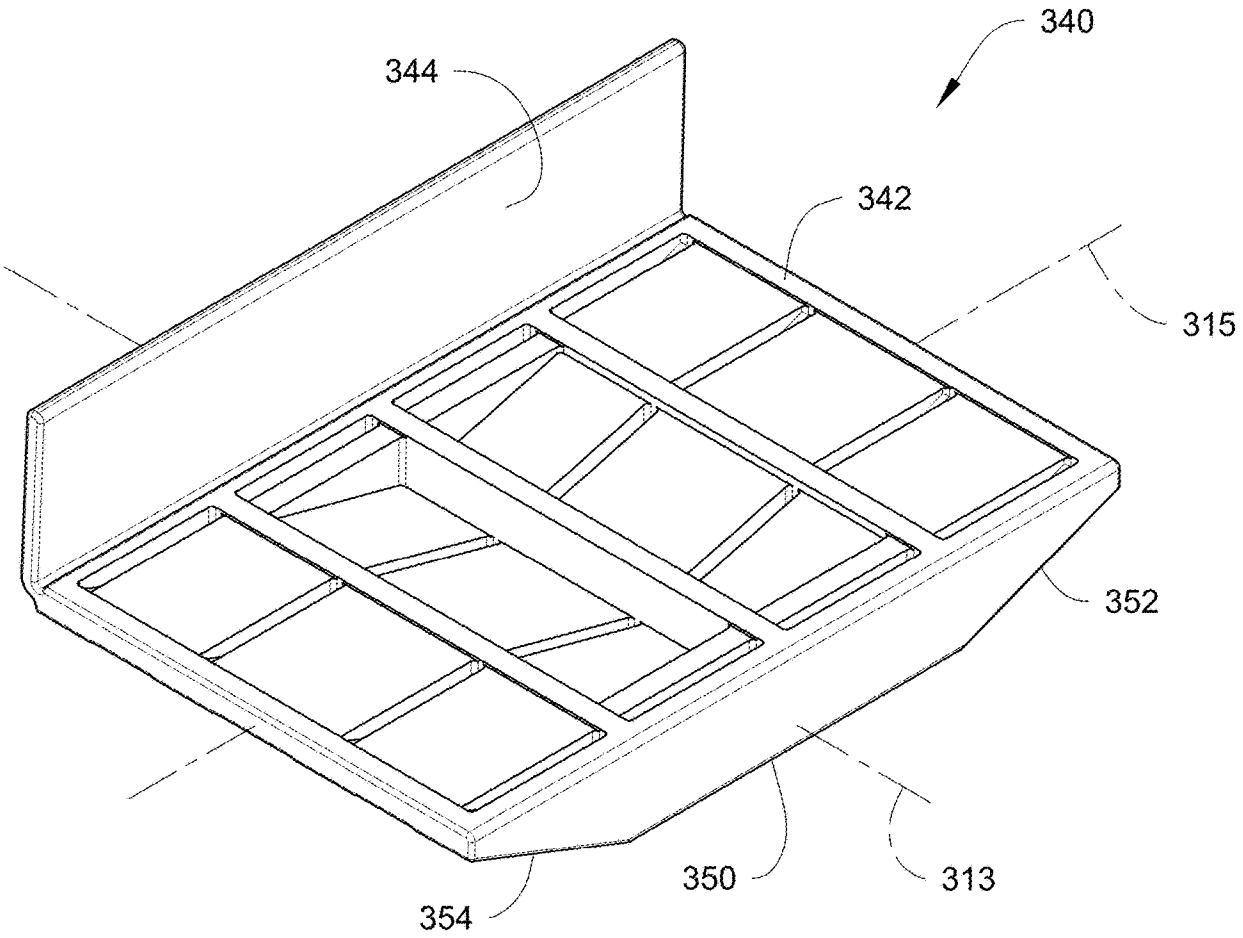
FIG. 11 is a top perspective view of the spacer block of FIG. 10.
Figure 12:
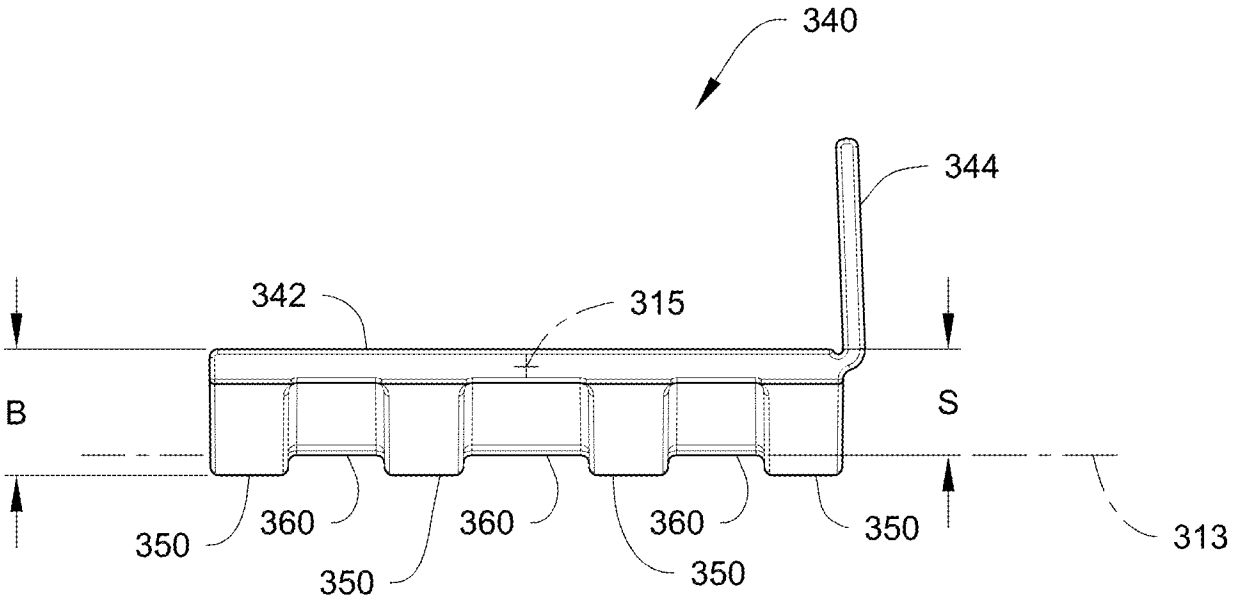
FIG. 12 is an end view of the spacer block of FIG. 10.
Figure 13:
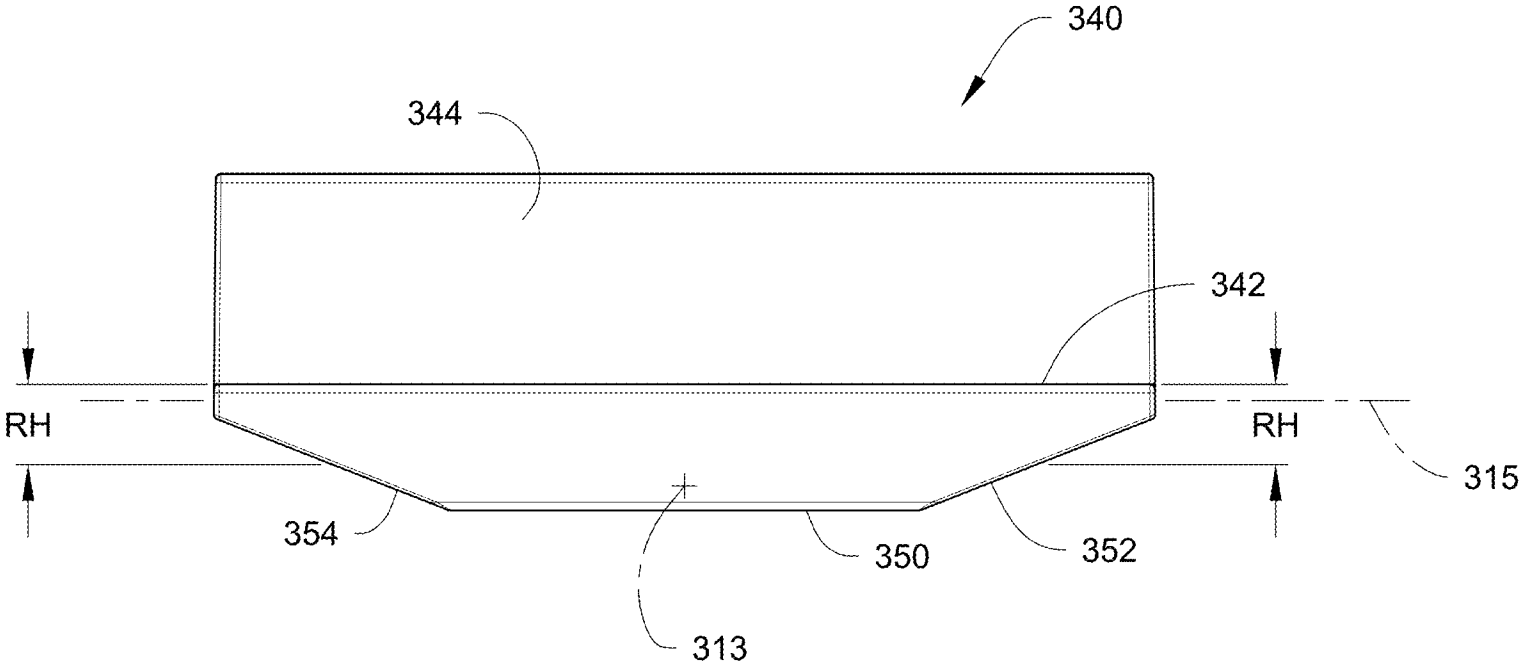
FIG. 13 is a side view of the spacer block of FIG. 10.
Figure 14:
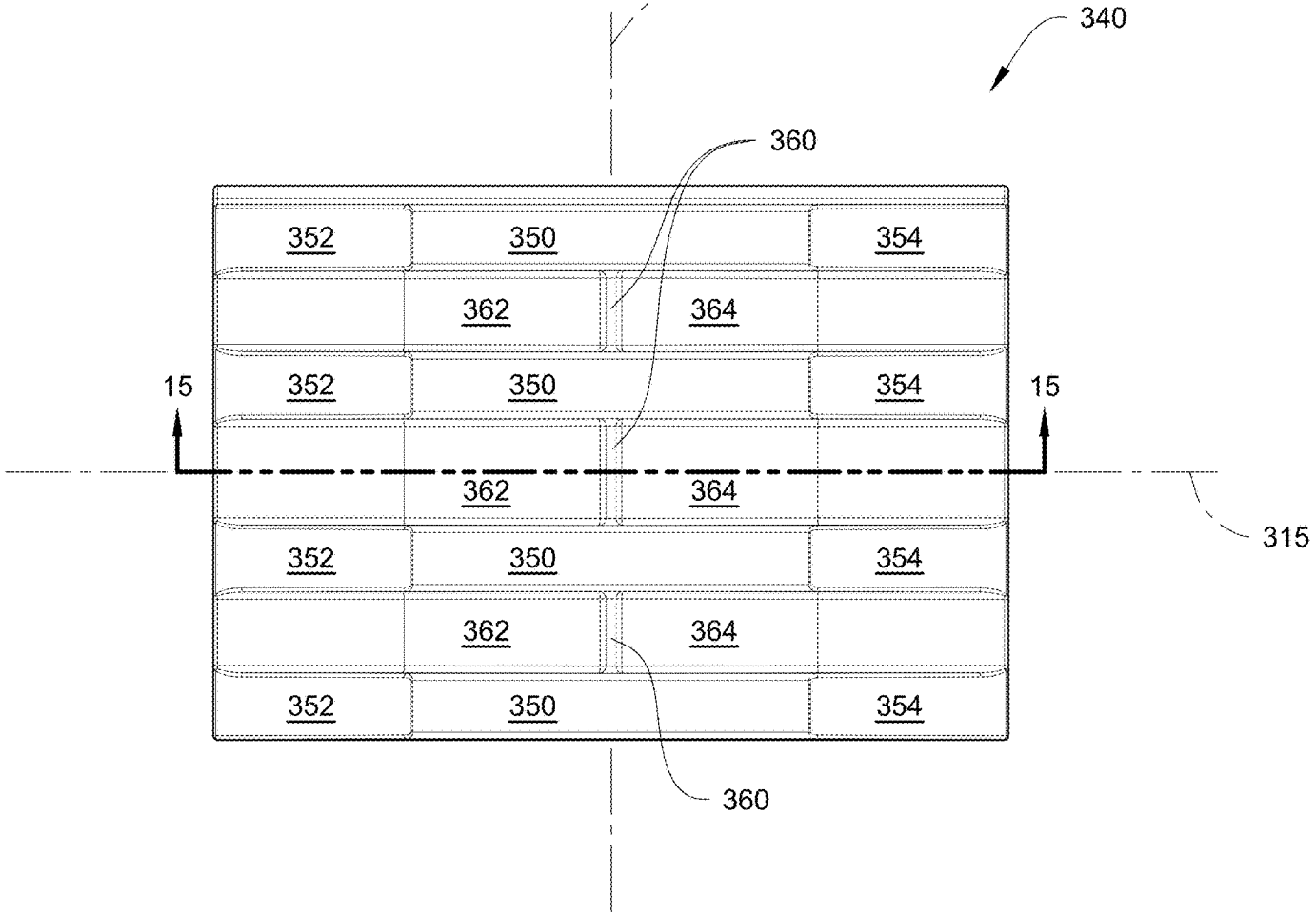
FIG. 14 is a plan view of the bottom of the spacer block of FIG. 10.
Figure 15:
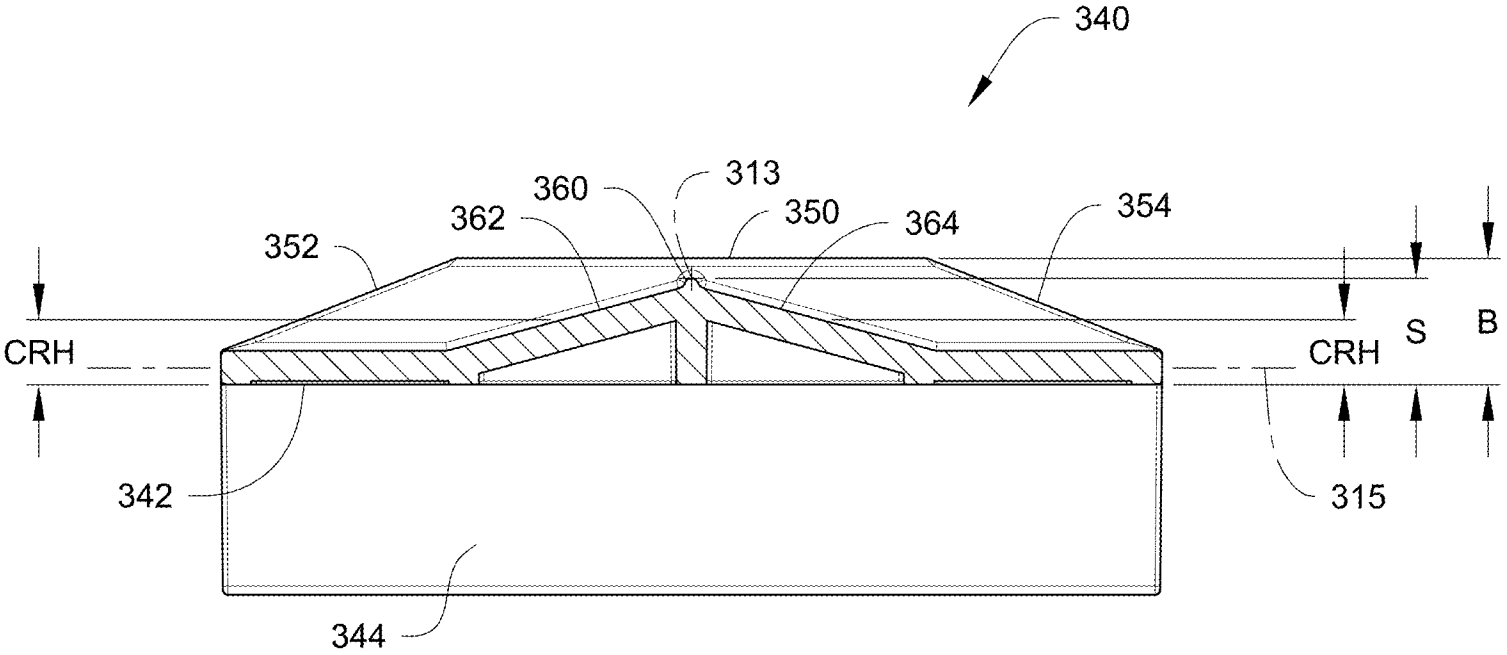
FIG. 15 is a cross-sectional view of the spacer block of FIG. 10 taken along line 15-15 in FIG. 14.
Figure 16:
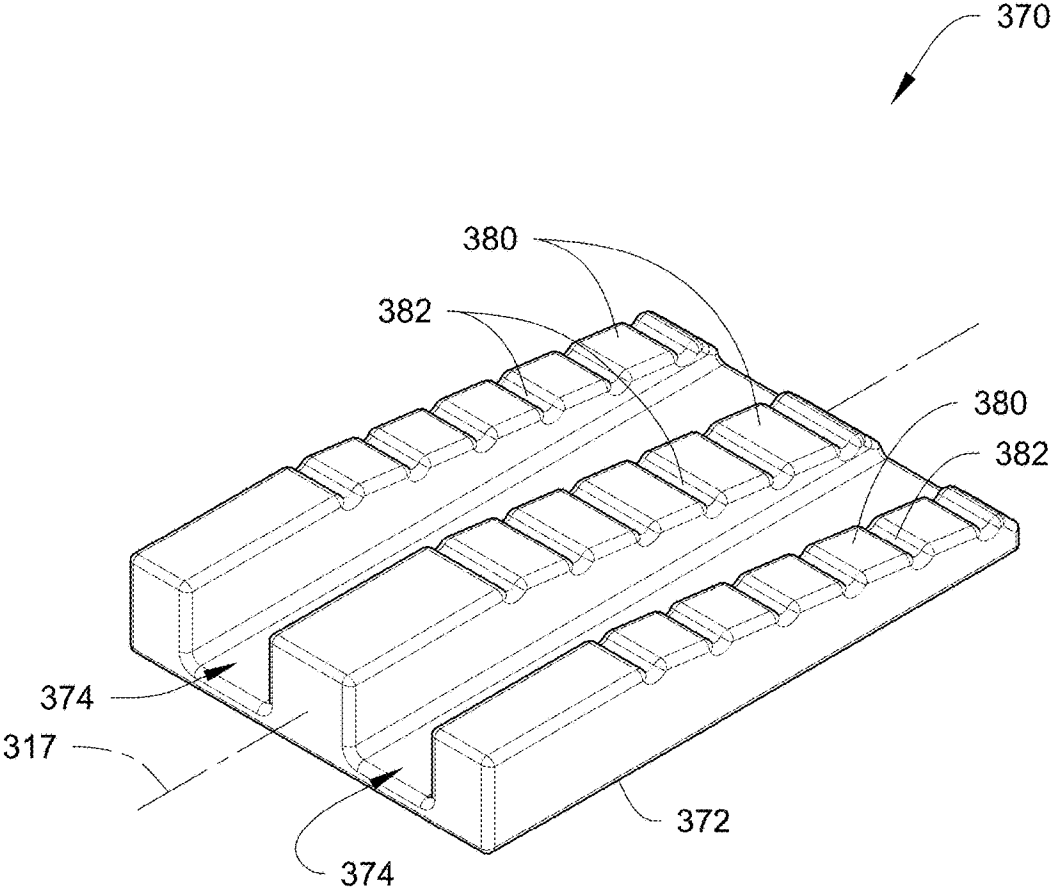
FIG. 16 is a perspective view of one illustrative embodiment of a shim wedge that may be used in conjunction with the spacer block of FIGS. 10-15.
Figure 17:
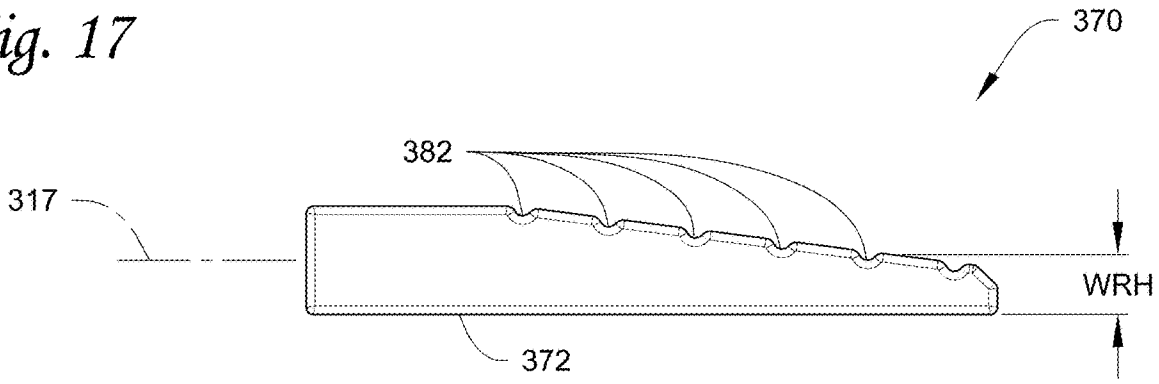
FIG. 17 is a side view of the shim wedge of FIG. 16.
Figure 18:
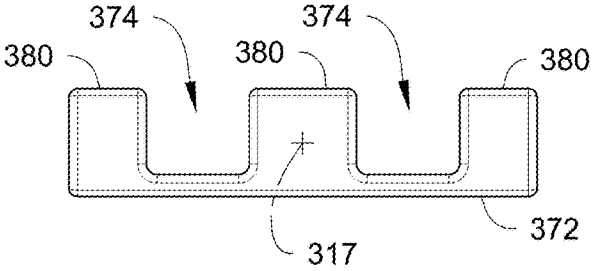
FIG. 18 is an end view of the shim wedge of FIG. 16.
Figure 19:
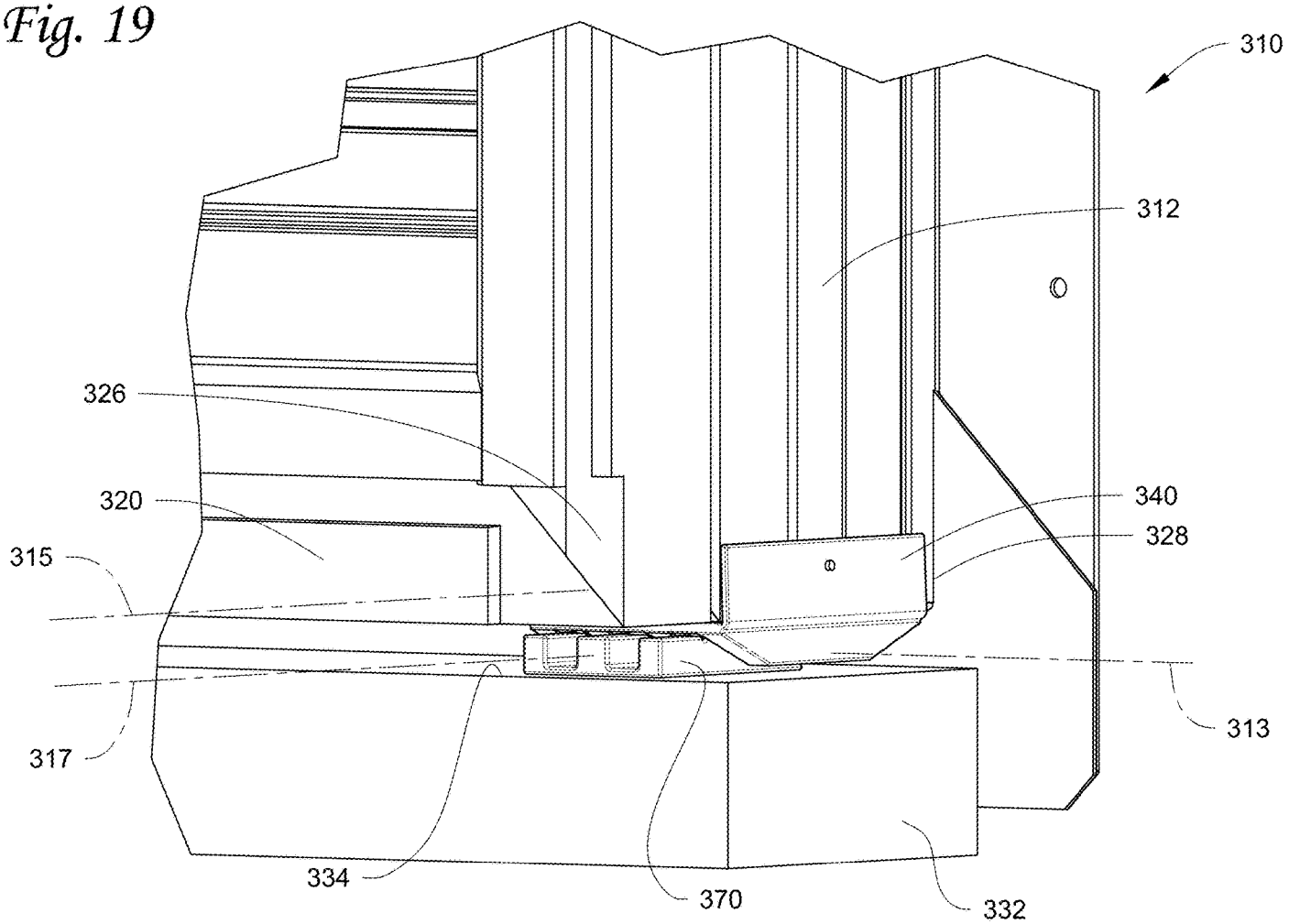
FIGS. 19 and 20A are perspective views of the spacer block of FIGS. 10-15 and the shim wedge of FIGS. 16-18 in use to support a fenestration unit above a rough opening sill.
Figure 20A:
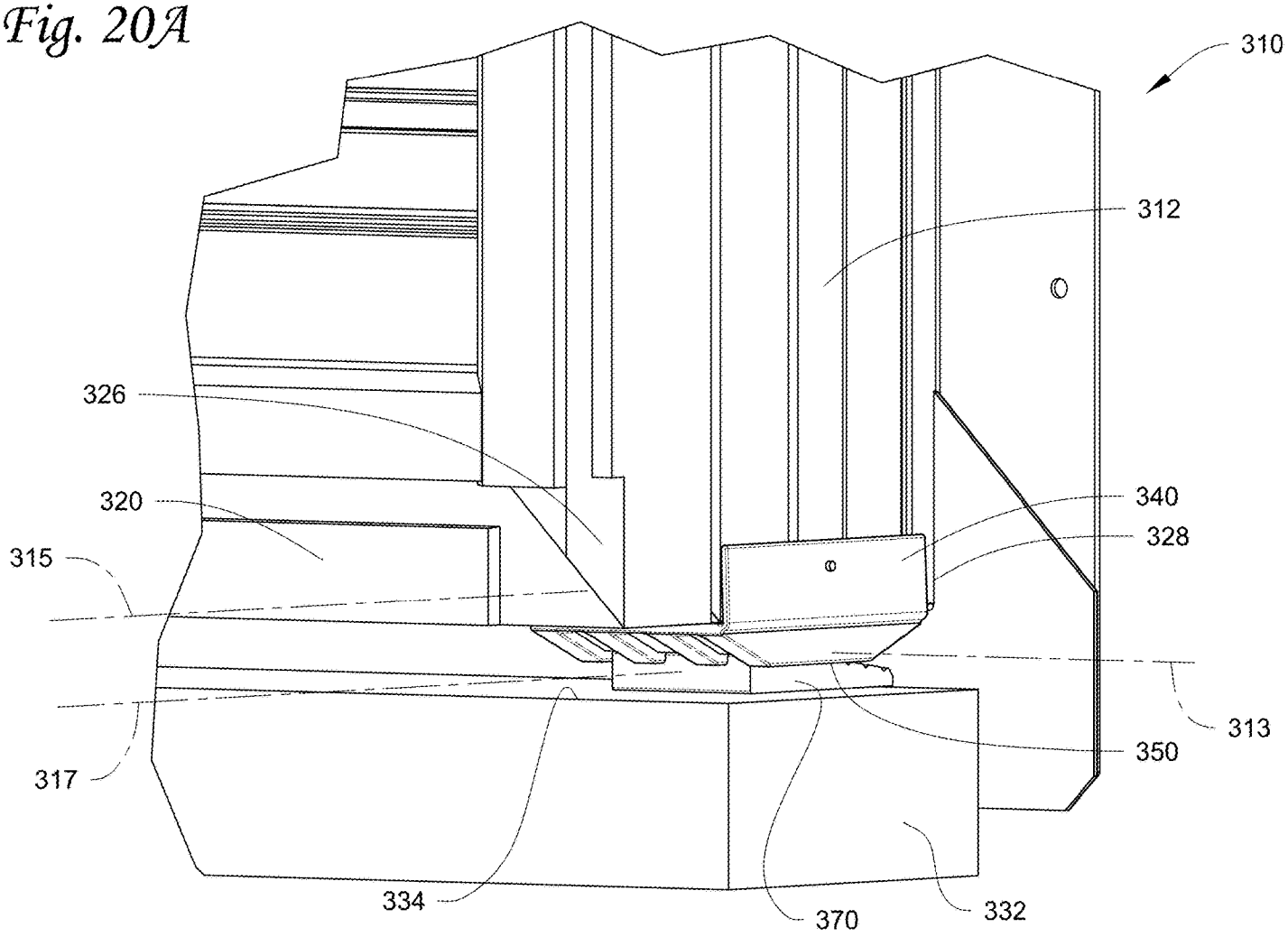

Although fenestration units using spacer blocks as described herein may be leveled during installation using conventional shims in addition to the spacer blocks, in one or more embodiments, the spacer blocks described herein may also be configured to receive and cooperate with wedge shims to selectively increase the height of a fenestration unit above a rough opening sill. One illustrative embodiment of an alternative spacer block that may be used with fenestration units as described herein is depicted in FIGS. 10-20. FIG. 10 is a bottom perspective view of the spacer block 340, FIG. 11 is a top perspective view of the spacer block 340 depicting the sill surface 342, FIG. 12 is an end view of the spacer block 340 when viewed along depth axis 315, FIG. 13 is a side view of the spacer block 340 when viewed along width axis 313, FIG. 14 is a plan view of the bottom of the spacer block 340 (where the bottom is the surface of the spacer block 340 that faces a rough opening sill when installed in a rough opening), and FIG. 15 is a cross-sectional view of the spacer block 340 taken along line 15-15 in FIG. 14. FIG. 16 is a perspective view of a shim wedge 370 that may be used in conjunction with the spacer block 340, FIG. 17 is a side view of the shim wedge 370, and FIG. 18 is an end view of the shim wedge 370. FIGS. 19 and 20A are perspective views of spacer block 340 and shim wedge 370 in use to support a fenestration unit 310 above a rough opening sill 332.

In one or more embodiments, spacer block 340 may include many of the same features found in, e.g., spacer blocks 40, 140, and 240 above. For example, the spacer block 340 may, in one or more embodiments, include a base having a sill surface 342, and attachment flange 344, bearing surfaces 350, leading ramp surfaces 352, trailing ramp surfaces 354, and channels 356 located between adjacent pairs of bearing surfaces 350 and ramp surfaces 352/354. Furthermore, all of the variations described above with respect to spacer block 40, 140, and 240 apply equally to spacer block 340. Spacer block 340 is also configured to be attached to a fenestration unit in manners similar to those described above with respect to spacer blocks 40 and 140.

In addition to the features found in spacer blocks 40, 140, and 240 as described above, the spacer block 340 may, in one or more embodiments, include additional features, in particular, spacer block 340 as depicted includes support ribs 360 and interior channel ramp surfaces 362 as seen in, e.g., FIG. 10. The support ribs 360 and interior channel ramp surfaces 362 are, in one or more embodiments, located within the channels 356 formed between adjacent pairs of bearing surfaces 350, leading ramp surfaces 352, and trailing ramp surfaces 354.

The interior channel ramp surfaces 362 define an interior channel ramp surface height (see, e.g., CRH in FIG. 15) that is measured between the sill surface 342 of the spacer block 340 and the interior channel ramp surface 362. In one or more embodiments, the interior channel ramp surface height decreases when moving along the depth axis 315 from the support rib 360 towards the interior edge 326 of the fenestration sill 320. That directional movement corresponds to movement along the depth axis 315 from the support rib 360 towards the leading ramp surface 352 of the spacer block 340.

The support ribs 360 within each channel 356 have a support rib height (see, e.g., Sin FIGS. 12 and 15) that is measured between the sill surface 342 of the spacer block 340 and the support rib 360. In one or more embodiments of spacer blocks having two or more support ribs as described herein, the support ribs 360 within different channels 356 may have the same support rib height and be aligned with each other along the same axis as depicted in connection with the illustrative embodiment of spacer block 340.

In one or more embodiments of spacer blocks as described herein, the bearing surfaces 350 may have a bearing surface height (see, e.g., B in FIGS. 12 and 15) that is measured between the bearing surface 350 and the sill surface 342 of the spacer block 340. In one or more embodiments of the spacer blocks described herein, the support rib height may be equal to or less than the bearing surface height of the bearing surfaces 350 on each side of the support rib 360.

In one or more embodiments, the spacer block 340 may include one or more support ribs 360 that define a support rib axis extending through the support rib 360. In the illustrative embodiment of spacer block 340 depicted in, e.g., FIGS. 10-15, the support rib axis may be co-linear with the width axis 313 as depicted in connection with spacer block 340. In one or more such embodiments, the support rib axis 313 may be described as extending through the bearing surface 350 when the support rib height is equal to the bearing surface height as described herein. In one or more alternative embodiments, the support rib axis 313 may be described as extending between the bearing surface 350 and the sill surface 342 of the base of the spacer block 340 when the support rib height is less than the bearing surface height as described herein.

In one or more embodiments of the spacer blocks including a support rib and an interior channel ramp surface, the spacer block may also include an exterior channel ramp surface located within the channels between bearing surfaces. In the illustrative embodiment of spacer block 340, the exterior channel ramp surfaces 364 are depicted in FIGS. 10, 14, and 15. The exterior channel ramp surfaces 364 define an exterior channel ramp surface height (see, e.g., CRH in FIG. 15) that is measured between the sill surface 342 of the spacer block 340 and the exterior channel ramp surface 364. In one or more embodiments, the exterior channel ramp surface height decreases when moving along the depth axis 315 from the support rib 360 towards the exterior edge 328 of a fenestration sill 320. That directional movement corresponds to movement along the depth axis 315 from the support rib 360 towards the trailing ramp surface 354 of the spacer block 340.

Although spacer blocks similar to those depicted in the illustrative embodiment of spacer block 340 may be used alone in the same manner as the spacer blocks 140 described above, the support ribs 360 and channel ramp surfaces 362 and 364 and are configured for use with a shim wedge, one illustrative example of which is depicted as shim wedge 370 in FIGS. 16-18.

The shim wedge 370 may, in one or more embodiments, include a wedge base 372 that is configured to sit on the top surface of a rough opening sill in which the fenestration unit to which a spacer block 340 is attached. This combination is seen in for example, FIGS. 19-20 which will be described in more detail below.

Shim wedge 370 may, in one or more embodiments, include one or more wedge ramp surfaces 380 that face away from the wedge base surface 372. In one or more embodiments, the wedge ramp surfaces 380 have a wedge ramp surface height (see, e.g., WRH in FIG. 17) measured between the wedge base surface 372 and the wedge ramp surface 380. The wedge ramp surface height may, in one or more embodiments, increase when moving along a length of the wedge ramp surface 380, where the length of the wedge ramp surface is measured along a direction aligned with wedge axis 317 as depicted in FIGS. 16-18. In one or more embodiments, the wedge axis 317 is aligned with the depth axis 315 as described herein in connection with the spacer blocks used on fenestration units described herein.

The wedge ramp surfaces 380 of shim wedges described herein may also include a wedge ramp surface with that is configured to fit within the channels 356 formed in the spacer blocks 340. In particular, the wedge ramp surface with may be such that the wedge ramp surface fits within the channel 356 between bearing surfaces 350 on either side of the channel 356. This complementary relationship between the wedge ramp surfaces 380 and the channels 356 may, in one or more embodiments, allow for movement of the shim wedge 370 along the direction of wedge axis 317 relative to the spacer block 340 which preferably remains stationary along that axis.

With the wedge ramp surfaces 380 located within the channel 356, the support ribs 360 in the channels 356 may, in one or more embodiments, be configured to rest on the wedge ramp surfaces 380 when the shim wedge 370 is located between the spacer block 340 and the top surface of a rough opening sill 320 on which the fenestration unit 310 is located (see, e.g., FIGS. 19-20). In such an arrangement, bearing surfaces 350 on the spacer block 340 may be received within wedge channels 374 located between adjacent wedge ramp surfaces 380 as seen in, e.g., FIG. 18.

Because the height of the wedge ramp surfaces 380 relative to the base 372 of the shim wedge 370 changes along the direction of the wedge axis 317, movement of the shim wedge 370 along the wedge axis 317 can be used to change the height of the support ribs 360 above the top surface of a rough opening sill 332. As a result, the height of the fenestration sill 320 of a fenestration unit 310 above the rough opening sill 332 may also be adjusted by movement of the shim wedge 370 along the shim axis 317.

This feature is depicted in, e.g., FIGS. 19 and 20A. The illustrative embodiment of spacer block 340 is attached to the side jamb 312 and/or the fenestration sill 320 of fenestration unit 310 as described above in connection with, e.g., fenestration unit 110 and spacer blocks 140. With the fenestration unit 310 positioned with its fenestration sill 320 located above the top surface 334 of a rough opening sill 332, the spacer block 340 is located above the top surface 334 of the rough opening sill 332.

The shim wedge 370 may be advanced along the wedge axis 317 with the shim wedge 370 aligned with the spacer block 340 such that the wedge ramp surfaces 380 enter the channels 356 of the spacer block 340. As the shim wedge 370 is advanced towards the exterior edge 328 of the fenestration sill 320 the wedge ramp surfaces 380 cooperate with the interior channel ramp surfaces 362 of the two raise the spacer block 340 and its attached fenestration unit 310 above the top surface 334 of the rough opening sill 332. This motion is seen in the differences between FIG. 19 and FIG. 20A, with the bearing surface 350 of the spacer block 340 being located at a greater height above the top surface 334 of the rough opening sill 332 in FIG. 20A after advancement of the shim wedge 370 along wedge axis 317 towards the exterior edge 328 of the fenestration sill 320 relative to the position of the shim wedge 370 as depicted in FIG. 19.

Figure 20B:
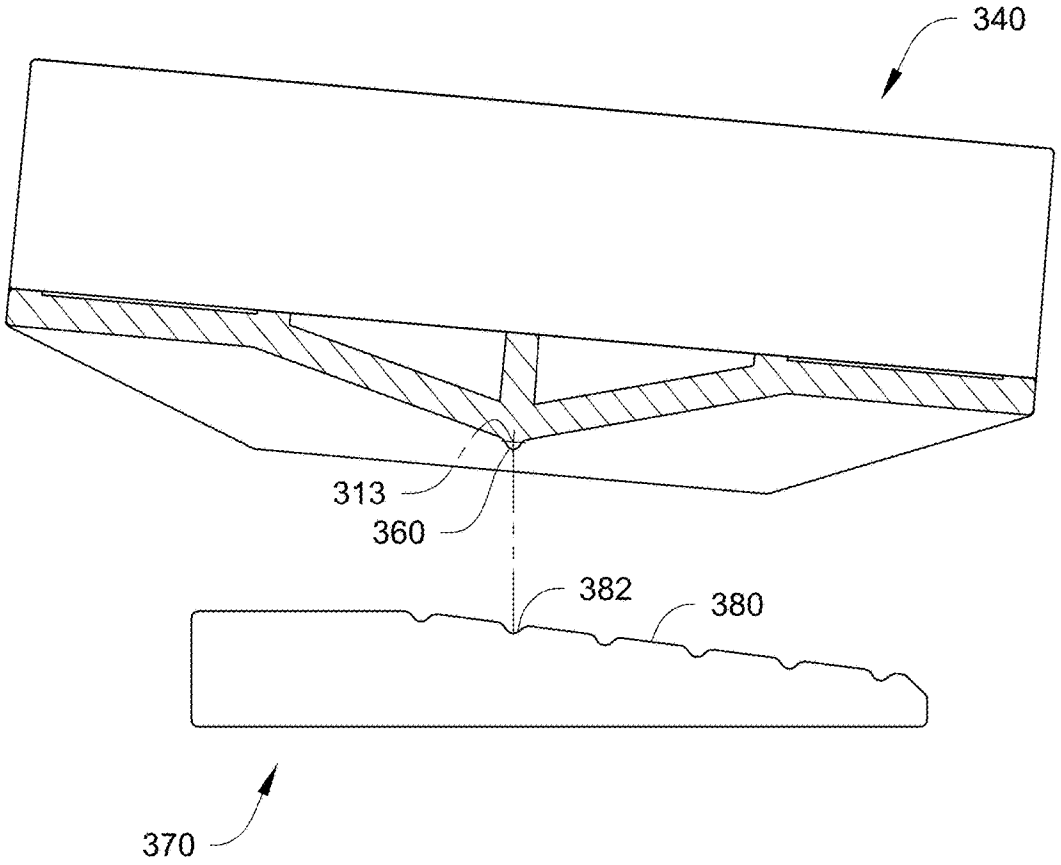
FIG. 20B depicts the spacer block and shim wedge of FIG. 20A isolated from the fenestration unit and the rough opening sill.

In one or more embodiments, the wedge ramp surfaces 380 may include one or more detents 382 that are configured to receive a support rib 360 on a spacer block 340. Where multiple detents 382 are provided, they may be spaced apart from each other along the length of the wedge ramp surface 380 and because the wedge ramp surface height changes along its length as described herein, the height of the detents 382 above the wedge base surface 372 is different along the length of the wedge ramp surface 380. FIG. 20B depicts, isolated from the fenestration unit and the rough opening sill, the spacer block 340 located above the shim wedge 370 to illustrate the positioning of support rib 360 in one of the detents 382 provided in the shim wedge 370. Although not required on the wedge ramp surfaces, the detents 382 may be able to more securely fix the position of the shim wedge 370 relative to the spacer block 340 in a selected position that corresponds to alignment of the support ribs 360 with the detents 382 on the shim wedge 370.

In one or more embodiments of spacer blocks 340 having support ribs 360 as described herein, the support ribs 360 may, in one or more embodiments, define an axis of rotation such that the spacer block 340 and the shim wedge 370 can rotate relative to each other about the axis of rotation. In the depicted embodiment of spacer block 340 the axis of rotation is collinear with the width axis 313 as depicted in FIGS. 10-15 which extends through the support ribs 360 of the spacer block 340.

Rotation between the spacer block and the shim wedge about an axis of rotation that, e.g., extends through a support rib 360 allows for a nonparallel orientation of the fenestration sill 320 (to which the spacer block 340 is attached) and the top surface 334 of the rough opening sill 332 (on which the base 372 of the shim wedge 370 rests).

Figure 21:
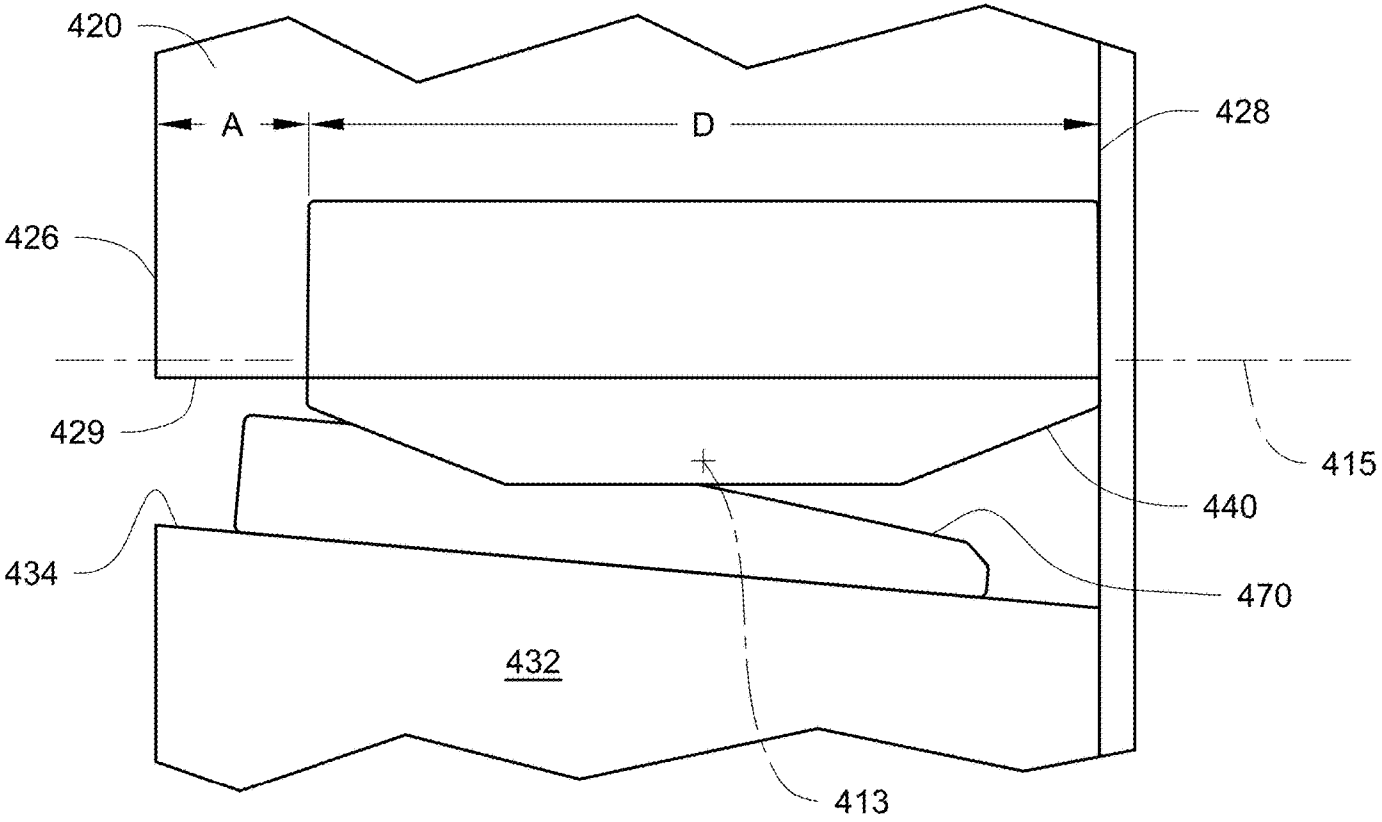
FIG. 21 depicts another illustrative embodiment of a fenestration unit having a spacer block and shim wedge as described herein.

One potential advantage of this rotational arrangement is that the top surface of the rough opening sill can be easily sloped to promote drainage of water if desired without increasing the difficulty of properly supporting a fenestration unit above the sloped rough opening sill. One illustrative embodiment of a system in which this concept is embodied is depicted in FIG. 21 in which a spacer block 440 is attached to a fenestration sill 420. The fenestration sill 420 is supported above the top surface 434 of a rough opening sill 432 by a shim wedge 470 that cooperates with the spacer block 442 support the fenestration sill 420. Although not depicted in FIG. 21, the spacer block 440 includes a support rib that defines an axis of rotation 413 when the support rib is supported by the shim wedge 470. As seen in FIG. 21, the top surface 434 of the rough opening sill 432 is significantly sloped relative to the bottom surface 429 of the fenestration sill 420 which is still, however, supported above the rough opening sill 432 despite the difference in orientation between those two surfaces.

Another optional feature of spacer blocks as used in fenestration units described herein is also depicted in connection with FIG. 21. That optional feature is in the shim depth as measured along the depth axis relative to the depth of the fenestration sill. In particular, the shim depth of spacer blocks as described herein may, in one or more embodiments, be less than a depth of the fenestration sill as measured along the depth axis between an exterior edge and an interior edge of the fenestration sill.

As depicted in FIG. 21, the fenestration sill 420 has an interior edge 426 and an exterior edge 428. As discussed above in connection with various illustrative embodiments, a depth axis 415 extends between the interior edge 426 and the exterior edge 428 of the fenestration sill 420. The spacer block 440 has a depth D along the depth axis 415 which is less than the depth of the fenestration sill 420 between its interior edge 426 and its exterior edge 428. The difference in the spacer block depth D and the fenestration sill depth is, in the depicted embodiment, indicated by reference letter A.

In one or more embodiments, the difference A between the spacer block depth D and the depth of the fenestration sill 420 between its interior edge 426 and its exterior edge 428 may be useful in forming a complete interior air seal around the frame of the fenestration unit between the frame members of the fenestration unit and the interior surfaces of the rough opening.

Figure 22:
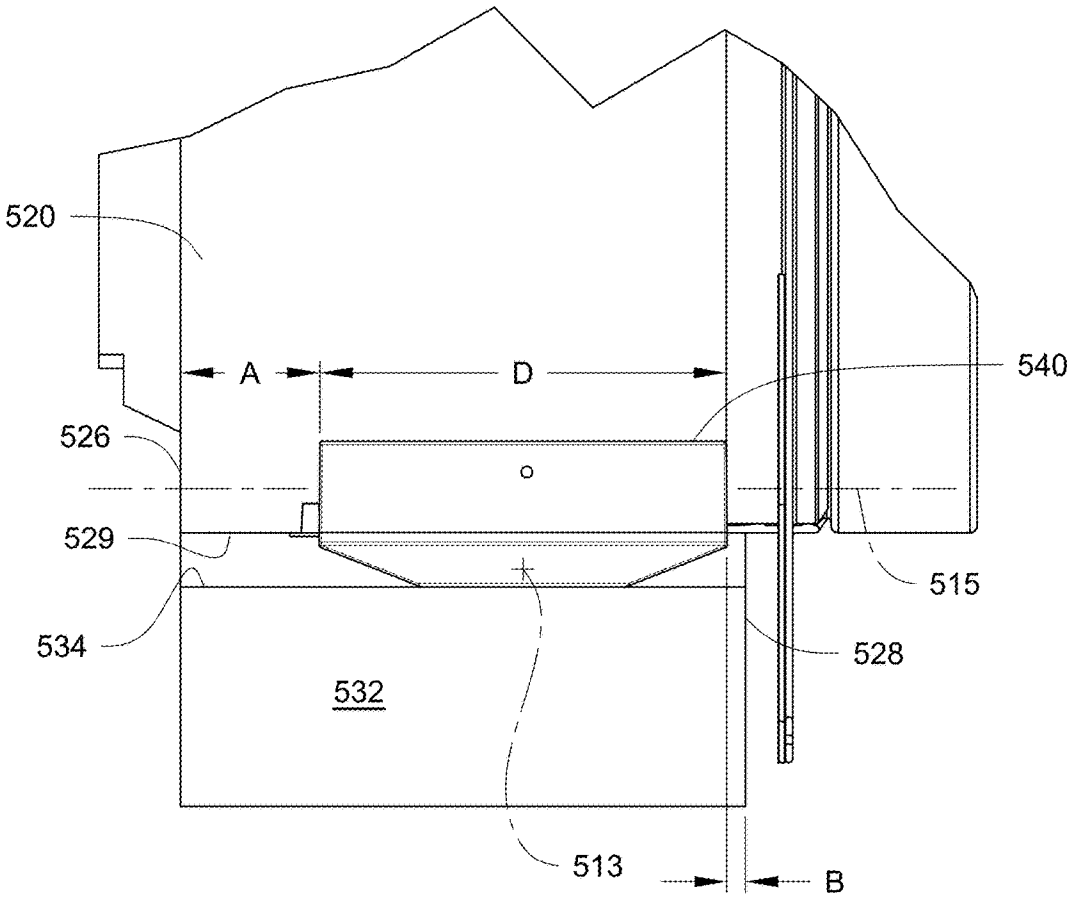
FIG. 22 is a side view of another illustrative embodiment of a fenestration unit having a spacer block to depict the depth of the spacer block and options for positioning of the spacer block relative to a fenestration sill and rough opening sill.

Another variation in placement of the spacer block 540 is depicted in FIG. 22. The fenestration sill 520 has an interior edge 526 and an exterior edge 528. As discussed above in connection with various illustrative embodiments, a depth axis 515 extends between the interior edge 526 and the exterior edge 528 of the fenestration sill 520. The spacer block 540 is placed such that it positions the bottom surface 529 of the fenestration sill 520 above the top surface 534 of the rough opening sill 532. Although not depicted in FIG. 22, the spacer block 540 includes a support rib that defines an axis of rotation 513 when the support rib is supported by a shim wedge as described herein.

The spacer block 540 has a depth D along the depth axis 515 which is less than the depth of the fenestration sill 520 between its interior edge 526 and its exterior edge 528. The spacer block 540 has a depth D that allows for spacing between the spacer block 540 and the interior edge 526 of the fenestration sill 520, as well as spacing between the spacer block 540 and the exterior edge 528 of the fenestration sill 520. In the depicted illustrative embodiment, the spacing between the interior edge of the spacer block 540 and the interior edge 526 of the fenestration sill is indicated by the reference letter A, while the spacing between the exterior edge of the spacer block 540 and the exterior edge 528 of the fenestration sill 520 is indicated by the reference letter B. intermediate placement of the spacer block 540 between both the interior edge 526 and the exterior edge 528 of the fenestration sill 520 may facilitate placement of the spacer block 540 in an intermediate location on the rough opening sill 532.

Also as discussed above, the distance A between the interior edge of the spacer block 540 and the interior edge 526 of the fenestration sill may be useful in forming a complete interior air seal around the frame of the fenestration unit between the frame members of the fenestration unit and the interior surfaces of the rough opening in which the fenestration unit is located.

Although illustrative embodiments of the spacer blocks and shim wedges are described herein having specific numbers of various features such as, e.g., bearing surfaces and support ribs. Specifically, the illustrative embodiments described herein of spacer blocks configured for use with shim wedges have four bearing surfaces and three support ribs located in channels between the four bearing surfaces. The corresponding shim wedge includes three wedge ramp surfaces, each of which is designed to cooperate with one of the support ribs on the spacer block. In other alternative embodiments, the spacer block may be provided with two bearing surfaces having only a single support rib located with a shim wedge designed for use with such a spacer block having only a single wedge ramp surface designed to cooperate with the single support rib. In another alternative embodiment, the spacer block may be provided with three bearing surfaces having to support ribs located between adjacent pairs of bearing surfaces and a shim wedge designed for use with such a spacer block that has two wedge ramp surfaces, each of which is designed to cooperate with one of the support ribs on the spacer block.

Yet another alternative embodiment of a spacer block and corresponding shim wedge as described herein are depicted in FIGS. 23-26. With reference to the illustrative embodiment of spacer block 640 depicted in FIGS. 23-25, the spacer block 640 includes many of the same features found in, e.g., spacer block 340 described herein. For example, the spacer block 640 may, in one or more embodiments, have a base having a sill surface 642, and attachment flange 644, a bearing surface 650, a leading ramp surface 652, and trailing ramp surface 654. The spacer block 640 has a depth along the depth axis 615 which, as described herein, may be less than the depth of a fenestration sill on which the spacer block 640 is mounted. The descriptions provided above with respect to these features in connection with the illustrative embodiment of spacer block 340 may also apply equally as well to the similarly named features found in spacer block 640.

Although the illustrative embodiments of shim wedges depicted herein have flat bearing surfaces facing and in contact with the corresponding rough opening sill surfaces, in one or more alternative embodiments it may be useful to provide shim wedges having discontinuous or ribbed bearing surfaces to, e.g., promote the drying or drainage of water or other fluids from beneath the fenestration units. Such discontinuous or ribbed bearing surfaces may, e.g., be similar to the multiple bearing surfaces described herein with respect to the spacer blocks (see, e.g., bearing surfaces 150 associated with spacer block 140).

One difference between spacer block 640 and spacer block 340 is in the number and arrangement of bearing surfaces and support ribs. For example, spacer block 640 includes only one bearing surface 650 and two support ribs 660 located on opposite sides of the bearing surface 640. As a result, the support ribs 660 are not located within a channel formed between two bearing surfaces as described herein in connection with the illustrative embodiment of spacer block 340. The support ribs 660 define an axis of rotation 613 when the support rib is supported by a shim wedge 670 as described herein.

The illustrative embodiment of spacer block 640 may, however, include other additional similar features such as, e.g., an interior support rib ramp surface 662 and an exterior support rib ramp surface 664 with the interior and exterior support rib ramp surfaces extending towards, respectively, the interior and exterior edges of a fenestration sill on which the spacer block 640 is located. Furthermore, the interior and exterior support rib ramp surfaces may also change height when moving away from the support ribs 660 as described above in connection with the illustrative embodiment of spacer block 340.

Figure 23:
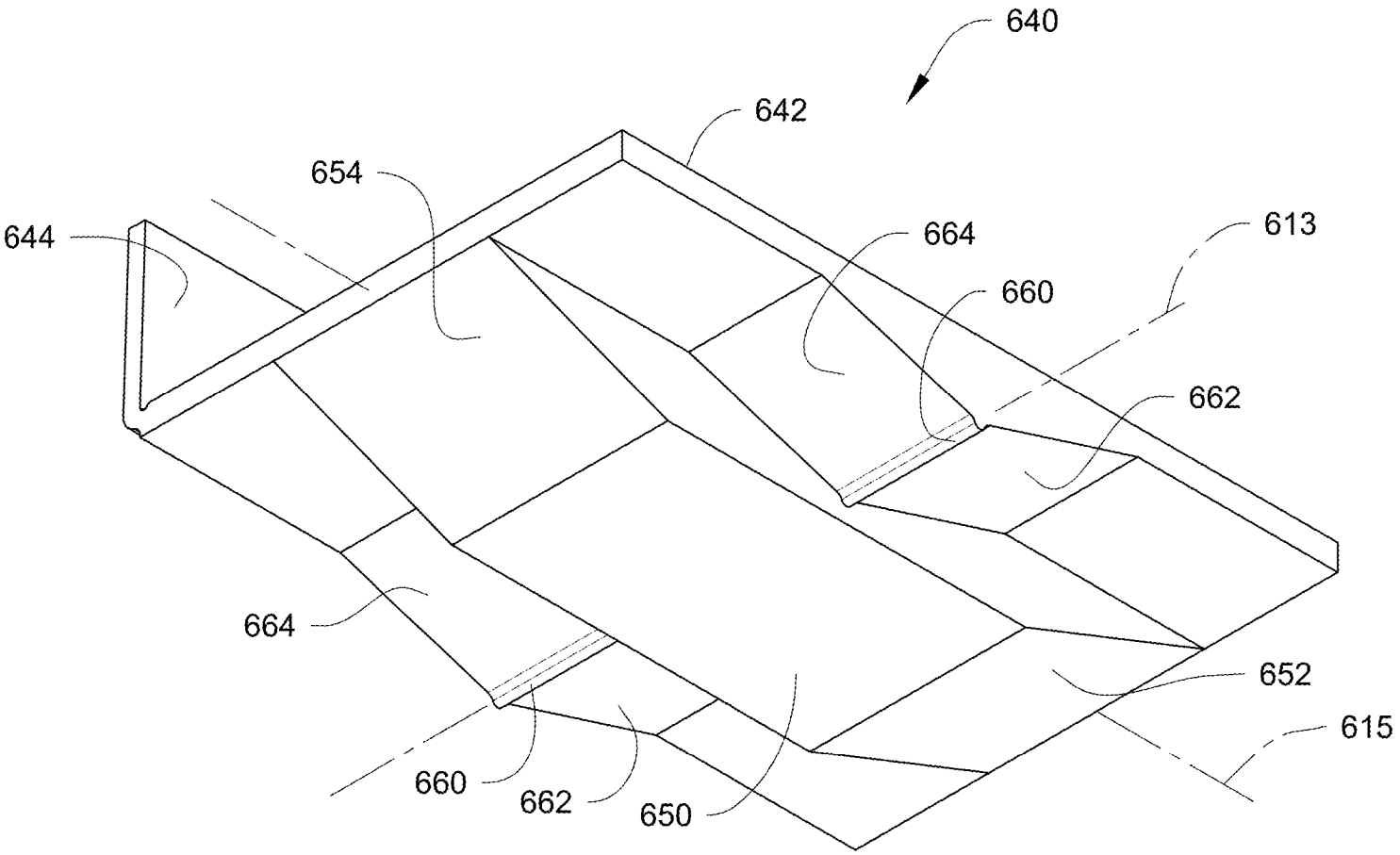
FIG. 23 is a bottom perspective view of another illustrative embodiment of a spacer block as described herein.
Figure 24:
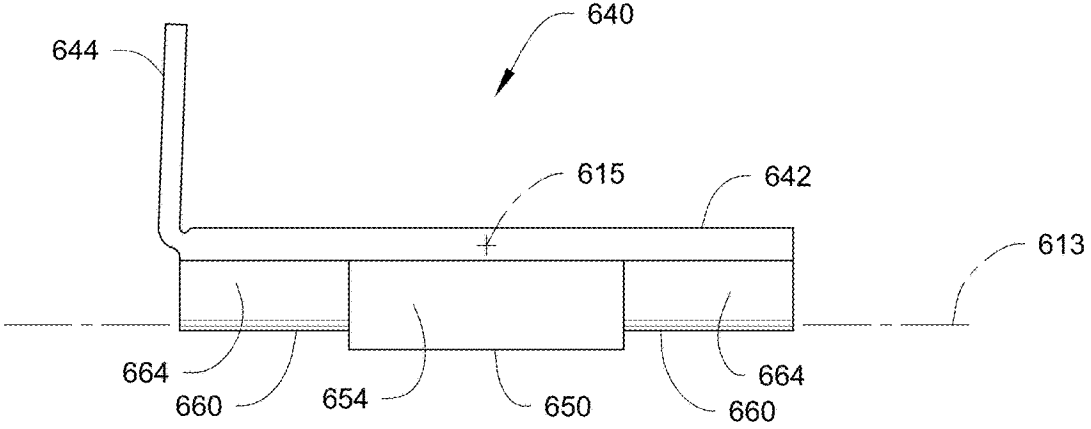
FIG. 24 is an end view of the spacer block of FIG. 23.
Figure 25:
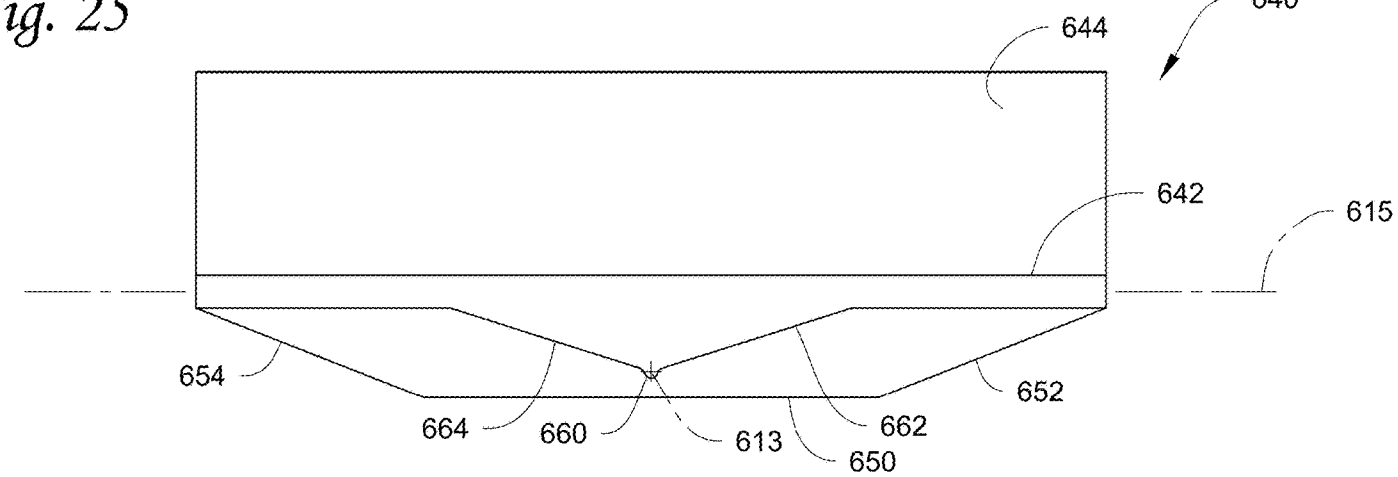
FIG. 25 is a side view of the spacer block of FIG. 23.
Figure 26:
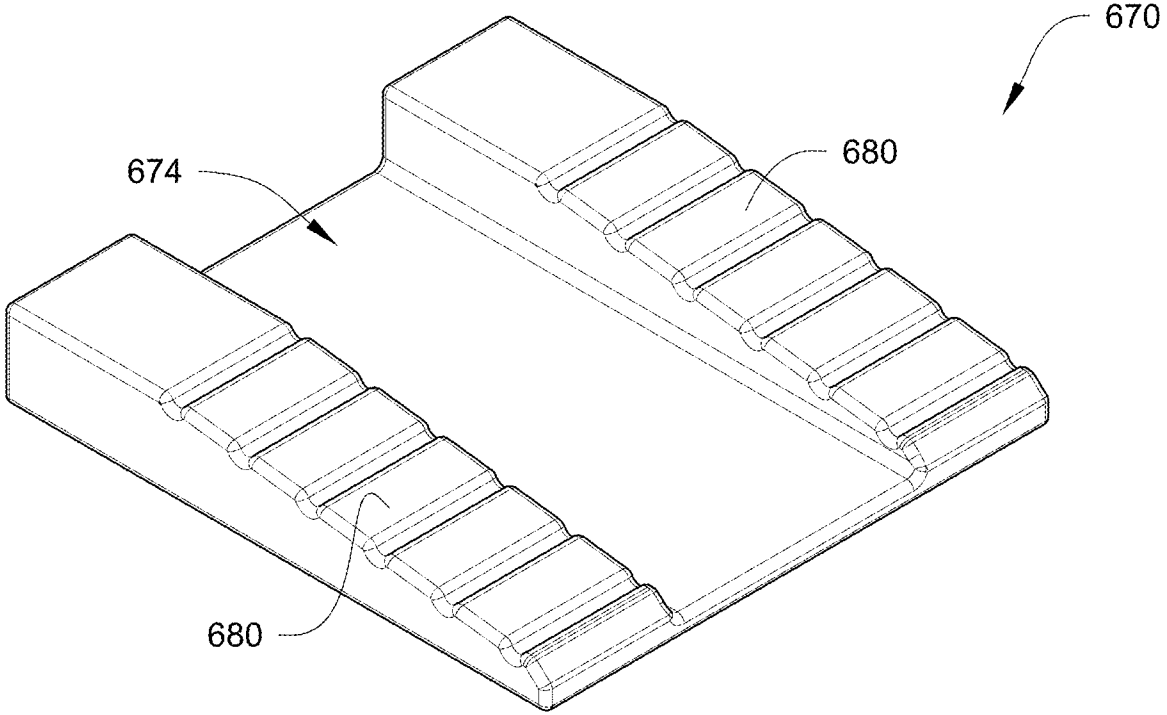
FIG. 26 is a perspective view of one illustrative embodiment of a shim wedge that may be used in conjunction with the spacer block of FIGS. 23-25.

The different configuration of spacer block 640 may also require adjustments in the features provided in connection with an optional shim wedge that may be used in connection with one or more embodiments of the spacer block 640. One illustrative embodiment of a shim wedge 670 that may be configured for use with, e.g., a spacer block 640 (as depicted in FIGS. 23-25) is depicted in FIG. 26. The shim wedge 670 includes ramp surfaces 680 similar to those found in the illustrative embodiment of shim wedge 370. The ramp surfaces 680 are, in one or more embodiments, positioned to cooperate with the leading ramp surfaces 652 of the spacer block 642 adjust the height of a fenestration unit as discussed above in connection with spacer block 340 and shim wedge 370. In the illustrative embodiment of shim wedge 670, the pair of ramp surfaces 680 are separated by a wedge channel 674 which may be sized and positioned to receive the bearing surface 650 of the spacer block 640.

As described herein, the spacer blocks may be attached to a fenestration unit during the manufacturing process. In one or more embodiments of the fenestration units described herein that include one or more shim wedges configured to be used with one or more of the spacer blocks on the fenestration unit, the shim wedge or wedges may also be attached to the fenestration unit. In one or more embodiments, the shim wedge may be attached to the fenestration unit before the fenestration unit is packaged for delivery to a customer. As used herein, attachment of a shim wedge to a fenestration unit may be accomplished using one or more of the following attachment techniques, adhesives, tapes, mechanical fasteners, clamps, etc.

While the shim wedges may be described as attached to the fenestration unit, in one or more embodiments, a shim wedge that is attached to the fenestration unit may, in fact, be attached to a spacer block which, in turn, is attached to the fenestration unit. In other words, the shim wedge may be attached to the fenestration unit using the spacer block. In one or more embodiments in which a shim wedge is attached to a spacer block, the shim wedge may be attached to the spacer block by a tether or structure. In one or more embodiments, the tether or other structure can be configured for separation such that the shim wedge and spacer block can be separated at, e.g., the time of installation of the fenestration unit. In one or more alternative embodiments, the tether or other structure may be configured to allow the shim wedge and spacer block to be used as described herein without requiring separation of the shim wedge and the spacer block from each other.

Figure 27:
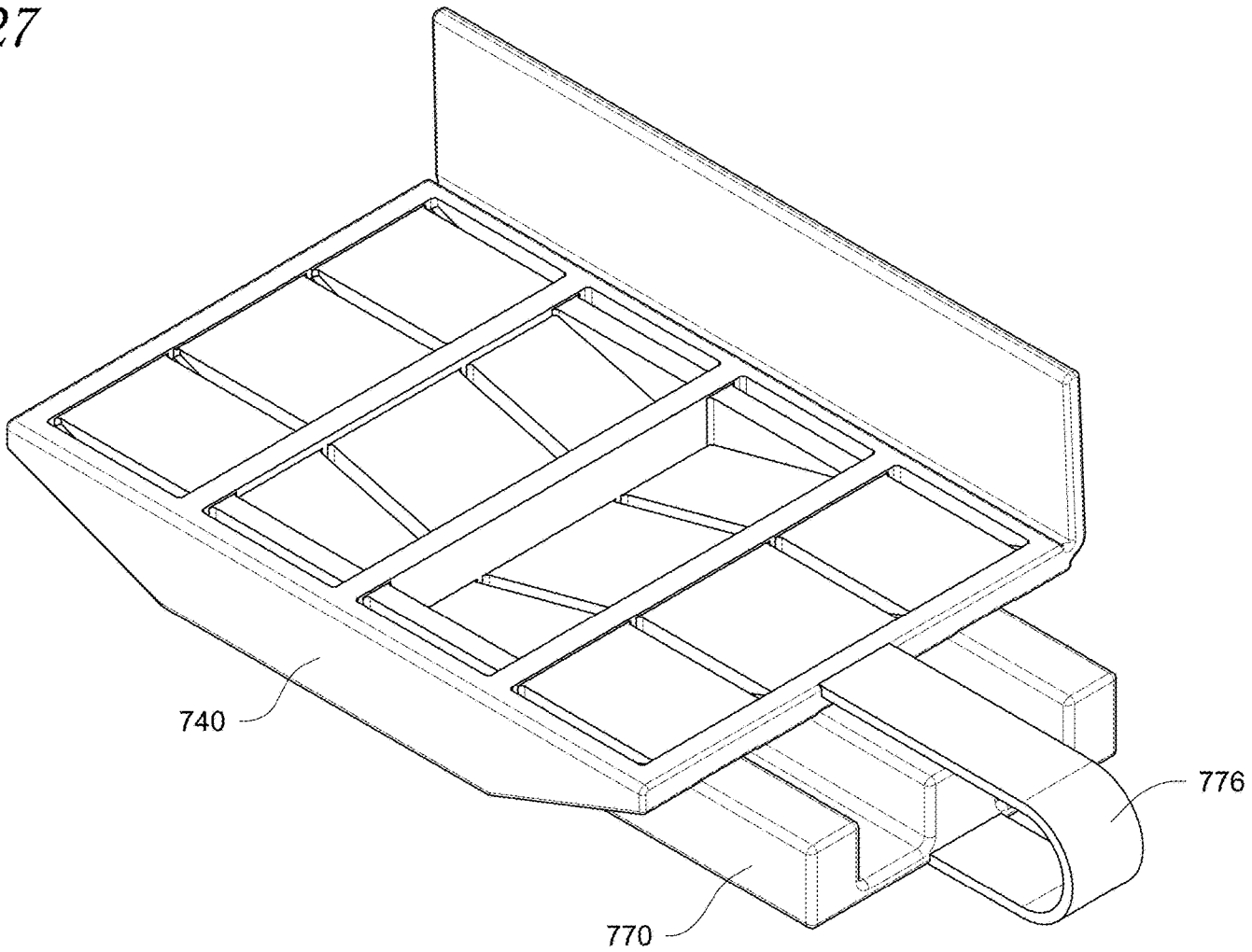
FIG. 27 is a perspective view of another illustrative embodiment of a spacer block and an attached shim wedge as described herein.

One illustrative example of such a construction is depicted in FIG. 27, where spacer block 740 and shim wedge 770 are attached to each other through a tether 776. In one or more embodiments in which the spacer block 740 and the shim wedge 770 are molded of multiple materials, the tether 776 may also be formed at the same time and, optionally, of the same material or materials as the spacer block 740 and the shim wedge 770, although such an arrangement is not required. As discussed above, in one or more embodiments, the tether 776 may be severed or otherwise separated from one or both of the spacer block 740 and the shim wedge 770 so that the spacer block 740 and the shim wedge 770 can be separated from each other. In other embodiments, however, a tether or other structure connecting the spacer block 740 and the shim wedge 770 may be configured such that the spacer block 740 and the shim wedge 770 can remain attached to each other during use and installation.

The fenestration units described herein may include spacer blocks on opposite ends of the fenestration sill to support the outermost edges of the fenestration unit in a rough opening as described herein. Some fenestration units, however, may be constructed as a combination of multiple fenestration units that are attached to each other along a mull joint. In such embodiments, it may be desirable to support the fenestration unit beneath each of such mull joints.

Figure 28:
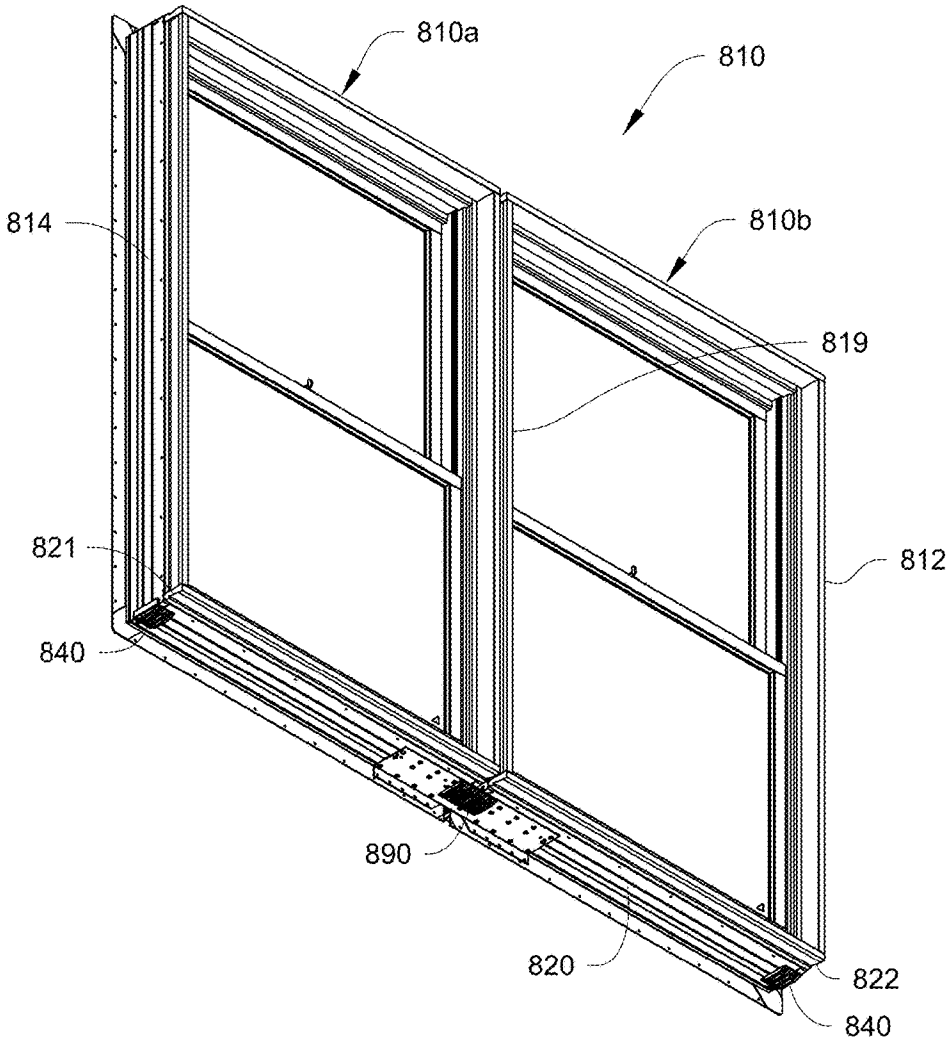
FIG. 28 is a perspective view of another illustrative embodiment of a fenestration unit including spacer blocks on the ends of the fenestration sill and a mull joint spacer block as described herein.

One illustrative example of a fenestration unit 810 is depicted in FIG. 28. The fenestration unit 810 includes a first subunit 810*a* and a second subunit 810*b* attached to each other along a mull joint 819. The fenestration unit 810 includes a first side jamb 812 and a second side jamb 814, both of which are supported by a spacer block 840 positioned at the first and second ends 821 and 822 of the fenestration sill 820 extending along the bottom of the fenestration unit 810.

The mull joint 819 of the fenestration unit 810 is located above an intermediate position between the first end 821 and the second end 822 of the fenestration sill 820. The mull joint spacer block 890 is attached to the bottom of the fenestration sill 820 at that intermediate position. As a result, the mull joint spacer block 890 is configured and positioned to be located between the bottom of the fenestration sill 820 and the top surface of a rough opening sill in which the fenestration unit 810 is located. In that location, the mull joint spacer block 890 may, in one or more embodiments, be positioned to support the fenestration sill at the intermediate position above the top surface of a rough opening sill as described herein in connection with spacer blocks located at the ends of the fenestration sills.

Figure 29:
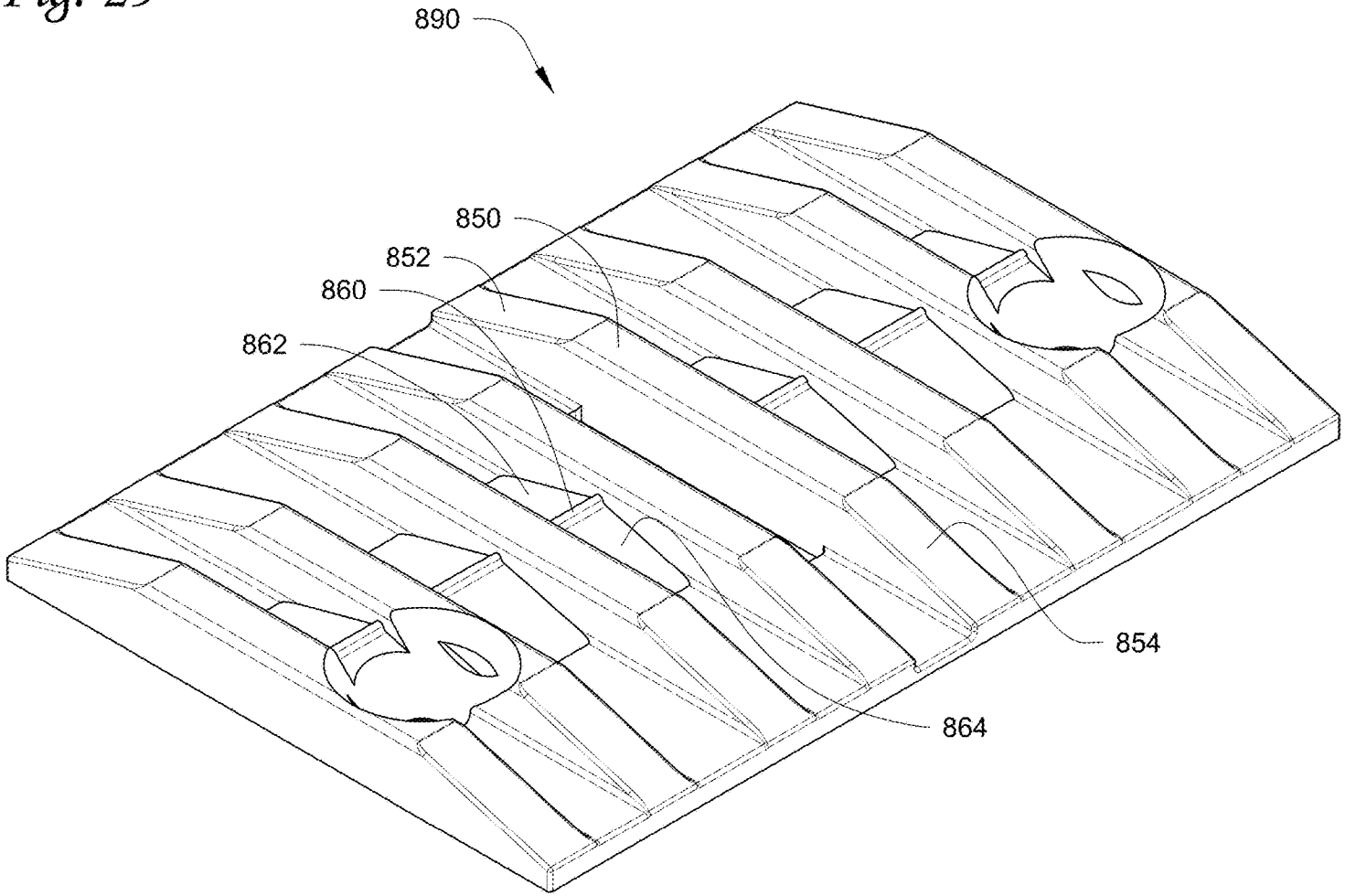
FIG. 29 is a perspective view of one illustrative embodiment of a spacer block that may be used as a mull joint spacer block as described herein.
Figure 30:
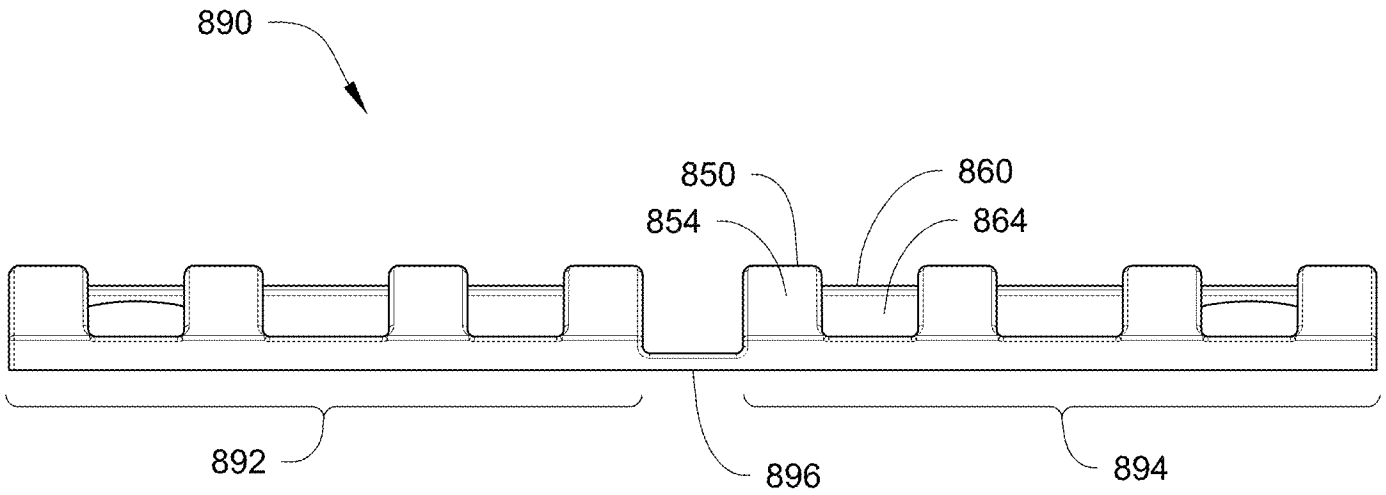
FIG. 30 is an end view of the spacer block of FIG. 29.

The illustrative embodiment of mull joint spacer block 890 is depicted in enlarged views in FIGS. 29-30. In one or more embodiments, mull joint spacer blocks such as mull joint spacer block 890 may include one or more bearing surfaces 850, leading ramp surfaces 852 extending away from the bearing surfaces 850, and trailing ramp surfaces 854 extending away from the bearing surfaces 850. The bearing surfaces 850 and ramp surfaces 852 and 854 may be used as described herein to support a fenestration sill above a rough opening sill. Also depicted in connection with the illustrative embodiment of mull joint spacer block 890 are one or more support ribs 860 and associated leading ramps 862 and trailing ramps 864. The support ribs 860 and corresponding ramp surfaces 862 and 864 may also be used as described herein to support a fenestration sill above a rough opening sill in connection with a shim wedge as described herein.

With respect to the end view depicted in FIG. 30, one or more embodiments of the mull joint spacer blocks as described herein may include separable units 892 and 894 which may be positioned under adjacent jams in the fenestration units that are connected to each other along a mull joint. Although the separable units 892 and 894 are depicted as connected by a joint 896, the penetration units described herein may include separate spacer blocks that are not connected to each other by such a joint 896.

The spacer blocks and, where provided, shim wedges used in connection with fenestration units as described herein may be constructed of any suitable material or combination of materials e.g., metal, wood, plastic, fiberglass, etc.

The complete disclosure of the patents, patent documents, and publications identified herein are incorporated by reference in their entirety as if each were individually incorporated. To the extent there is a conflict or discrepancy between this document and the disclosure in any such incorporated document, this document will control.

Illustrative embodiments of the fenestration units having spacer blocks (and, optionally, shim wedges) and methods of installing the fenestration units are discussed herein some possible variations have been described. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof. It should also be understood that this invention also may be suitably practiced in the absence of any element not specifically disclosed as necessary herein.

What is claimed is:

1. A fenestration unit comprising:

a fenestration frame comprising a fenestration sill, a first side jamb, and a second side jamb, wherein the fenestration sill extends between a first end and a second end along a width axis of the fenestration frame, wherein the first side jamb extends upwards from the first end of the fenestration sill and the second side jamb extends upwards from the second end of the fenestration sill, and wherein the fenestration sill comprises an interior edge and an exterior edge with a depth axis of the fenestration frame extending between the interior and exterior edges, wherein the depth axis is transverse to the width axis;

a first spacer block attached to the fenestration frame along a bottom of the fenestration sill at the first end of the fenestration sill, wherein the first spacer block is configured to be located between the bottom of the fenestration sill and a top surface of a rough opening sill in which the fenestration unit is located; and a second spacer block attached to the fenestration frame along a bottom of the fenestration sill at the second end of the fenestration sill, wherein the second spacer block is configured to be located between the bottom of the fenestration sill and the top surface of a rough opening sill in which the fenestration unit is located, and wherein the second spacer block comprises:

a base comprising a sill surface facing the bottom of the fenestration sill;

a bearing surface facing away from the bottom of the fenestration sill, wherein the bottom of the fenestration sill at the second end is supported against the force of gravity above a top surface of a rough opening sill by the bearing surface when the fenestration frame is located in a rough opening defined along one side by the rough opening sill;

a leading ramp surface extending from the bearing surface towards the interior edge of the fenestration sill, wherein the leading ramp surface defines a leading ramp surface height measured between the sill surface of the base and the leading ramp surface that decreases when moving along the depth axis from the bearing surface towards the interior edge of the fenestration sill.

2. A fenestration unit according to claim 1, wherein the bearing surface of the second spacer block is located a uniform distance from the sill surface of the base when moving along the bearing surface in the direction of the depth axis.

3. A fenestration unit according to claim 1, wherein the leading ramp surface height of the leading ramp surface changes linearly when moving along the depth axis from the bearing surface towards the interior edge of the fenestration sill.

4. A fenestration unit according to claim 1, wherein the leading ramp surface height of the leading ramp surface changes at different rates when moving along the depth axis from the bearing surface towards the interior edge of the fenestration sill.

5. A fenestration unit according to claim 1, wherein the second spacer block comprises a trailing ramp surface extending from the bearing surface towards the exterior edge of the fenestration sill, wherein the trailing ramp surface defines a trailing ramp surface height measured between the sill surface of the base and the trailing ramp surface that decreases when moving along the depth axis from the bearing surface towards the exterior edge of the fenestration sill, and wherein the bearing surface is located between the leading ramp surface and the trailing ramp surface.

6. A fenestration unit according to claim 1, wherein the second spacer block comprises:

a support rib defining a support rib axis extending through the support rib, wherein the support rib axis is aligned with the width axis, wherein the rib axis extends through the bearing surface or between the bearing surface and the sill surface of the base of the second spacer block, wherein the support rib comprises a support rib height measured between the sill surface of the base and the support rib that is equal to or less than a bearing surface height of the bearing surface as measured between the sill surface of the base and the bearing surface; and an interior support rib ramp surface extending from the support rib towards the interior edge of the fenestration sill, wherein the interior support rib ramp surface defines an interior support rib ramp surface height measured between the sill surface of the base and the interior support rib ramp surface that decreases when moving along the depth axis from the support rib towards the interior edge of the fenestration sill.

7. A fenestration unit according to claim 6, wherein the fenestration unit comprises a shim wedge that comprises:

a shim wedge base comprising a wedge base surface configured to sit on the top surface of a rough opening sill in which the fenestration unit is located;

a wedge ramp surface facing away from the wedge base surface, wherein the wedge ramp surface comprises wedge ramp surface height measured between the wedge base surface and the wedge ramp surface, wherein the wedge ramp surface height increases when moving along a length of the wedge ramp surface, wherein the length is measured in a direction transverse to the wedge ramp surface width;

wherein the support rib is configured to rest on the wedge ramp surface when the shim wedge is located between the second spacer block and the top surface of a rough opening sill in which the fenestration unit is located.

8. A fenestration unit according to claim 7, wherein the wedge ramp surface comprises a plurality of detents spaced apart from each other along the length of the wedge ramp surface, wherein the plurality of detents are located at different wedge ramp surface heights.

9. A fenestration unit according to claim 7, wherein the support rib defines an axis of rotation, and wherein the second spacer block and the shim wedge can rotate relative to each other about the axis of rotation such that the sill surface of the base of the second spacer block and the wedge base can be arranged in non-parallel orientations.

10. A fenestration unit according to claim 7, wherein the shim wedge is attached to the fenestration unit.

11. A fenestration unit according to claim 7, wherein the shim wedge is attached to the second spacer block.

12. A fenestration unit according to claim 1, wherein the fenestration unit comprises a mull joint located at an intermediate position between the first end and the second end of the fenestration sill, and wherein a mull joint spacer block is attached to the fenestration frame along a bottom of the fenestration sill at the intermediate position, wherein the mull joint spacer block is configured to be located between the bottom of the fenestration sill and the top surface of a rough opening sill in which the fenestration unit is located, and wherein the mull joint spacer block comprises:

a base comprising a sill surface facing the bottom of the fenestration sill;

a bearing surface facing away from the bottom of the fenestration sill;

a leading ramp surface extending from the bearing surface towards the interior edge of the fenestration sill, wherein the leading ramp surface defines a leading ramp surface height measured between the sill surface of the base and the leading ramp surface that decreases when moving along the depth axis from the bearing surface towards the interior edge of the fenestration sill.

13. A fenestration unit according to claim 12, wherein the bearing surface of the mull joint spacer block is located a uniform distance from the sill surface of the base when moving along the bearing surface of the mull joint spacer block in the direction of the depth axis.

14. A fenestration unit according to claim 12, wherein the leading ramp surface height of the leading ramp surface changes linearly when moving along the depth axis from the bearing surface towards the interior edge of the fenestration sill.

15. A fenestration unit according to claim 12, wherein the leading ramp surface height of the leading ramp surface changes at different rates when moving along the depth axis from the bearing surface towards the interior edge of the fenestration sill.

16. A fenestration unit according to claim 12, wherein the mull joint spacer block comprises a trailing ramp surface extending from the bearing surface towards the exterior edge of the fenestration sill, wherein the trailing ramp surface defines a trailing ramp surface height measured between the sill surface of the base and the trailing ramp surface that decreases when moving along the depth axis from the bearing surface towards the exterior edge of the fenestration sill, and wherein the bearing surface is located between the leading ramp surface and the trailing ramp surface.

17. A fenestration unit according to claim 12, wherein the mull joint spacer block comprises:

a support rib defining a support rib axis extending through the support rib, wherein the support rib axis is aligned with the width axis, wherein the rib axis extends through the bearing surface or between the bearing surface and the sill surface of the base of the mull joint spacer block, wherein the support rib comprises a support rib height measured between the sill surface of the base and the support rib that is equal to or less than a bearing surface height of the bearing surface as measured between the sill surface of the base and the bearing surface; and an interior support rib ramp surface extending from the support rib towards the interior edge of the fenestration sill, wherein the interior support rib ramp surface defines an interior support rib ramp surface height measured between the sill surface of the base and the interior support rib ramp surface that decreases when moving along the depth axis from the support rib towards the interior edge of the fenestration sill.

18. A fenestration unit according to claim 17, wherein the fenestration unit comprises a mull joint shim wedge that comprises:

a shim wedge base comprising a wedge base surface configured to sit on the top surface of a rough opening sill in which the fenestration unit is located;

a wedge ramp surface facing away from the wedge base surface, wherein the wedge ramp surface comprises wedge ramp surface height measured between the wedge base surface and the wedge ramp surface, wherein the wedge ramp surface height increases when moving along a length of the wedge ramp surface, wherein the length is measured in a direction transverse to the wedge ramp surface width;

wherein the support rib is configured to rest on the wedge ramp surface when the mull joint shim wedge is located between the mull joint spacer block and the top surface of a rough opening sill in which the fenestration unit is located.

19. A fenestration unit according to claim 18, wherein the wedge ramp surface of the mull joint shim wedge comprises a plurality of detents spaced apart from each other along the length of the wedge ramp surface, wherein the plurality of detents are located at different wedge ramp surface heights.

20. A fenestration unit according to claim 18, wherein the support rib of the mull joint shim wedge defines an axis of rotation, and wherein the mull joint spacer block and the shim wedge can rotate relative to each other about the axis of rotation such that the sill surface of the base of the mull joint spacer block and the wedge base can be arranged in non-parallel orientations.

21. A fenestration unit according to claim 18, wherein the mull joint shim wedge is attached to the fenestration unit.

22. A fenestration unit according to claim 18, wherein the mull joint shim wedge is attached to the mull joint spacer block.

23. A fenestration unit according to claim 1, wherein the second spacer block comprises a shim depth measured along the depth axis that is less than a depth of the fenestration sill as measured along the depth axis between the exterior edge and the interior edge of the fenestration sill.

24. A method of manufacturing a fenestration unit, wherein the method comprises:

attaching a first spacer block to the fenestration frame along a bottom of a fenestration sill of the fenestration unit at a first end of the fenestration sill, wherein the fenestration sill extends between the first end and a second end along a width axis of the fenestration frame, and wherein the fenestration sill comprises an interior edge and an exterior edge with a depth axis of the fenestration frame extending between the interior and exterior edges, wherein the depth axis is transverse to the width axis; and attaching a second spacer block to the fenestration frame along the bottom of the fenestration sill at the second end of the fenestration sill;

wherein the first spacer block and the second spacer block are attached to the fenestration sill before the fenestration unit is installed in a rough opening in a building structure;

and wherein the second spacer block comprises:

a base comprising a sill surface facing the bottom of the fenestration sill;

a bearing surface facing away from the bottom of the fenestration sill, wherein the bottom of the fenestration sill at the second end is supported against the force of gravity above a top surface of a rough opening sill by the bearing surface when the fenestration frame is located in a rough opening defined along one side by the rough opening sill; and a leading ramp surface extending from the bearing surface towards the interior edge of the fenestration sill, wherein the leading ramp surface defines a leading ramp surface height measured between the sill surface of the base and the leading ramp surface that decreases when moving along the depth axis from the bearing surface towards the interior edge of the fenestration sill.

25. A method according to claim 24, wherein the method further comprises attaching a shim wedge to the fenestration unit;

wherein the second spacer block comprises:

a support rib defining a support rib axis extending through the support rib, wherein the support rib axis is aligned with the width axis, wherein the rib axis extends through the bearing surface or between the bearing surface and the sill surface of the base of the second spacer block, wherein the support rib comprises a support rib height measured between the sill surface of the base and the support rib that is equal to or less than a bearing surface height of the bearing surface as measured between the sill surface of the base and the bearing surface; and an interior support rib ramp surface extending from the support rib towards the interior edge of the fenestration sill, wherein the interior support rib ramp surface defines an interior support rib ramp surface height measured between the sill surface of the base and the interior support rib ramp surface that decreases when moving along the depth axis from the support rib towards the interior edge of the fenestration sill;

and wherein the shim wedge comprises:

a shim wedge base comprising a wedge base surface configured to sit on the top surface of a rough opening sill in which the fenestration unit is located;

a wedge ramp surface facing away from the wedge base surface, wherein the wedge ramp surface comprises wedge ramp surface height measured between the wedge base surface and the wedge ramp surface, wherein the wedge ramp surface height increases when moving along a length of the wedge ramp surface, wherein the length is measured in a direction transverse to the wedge ramp surface width;

wherein the support rib is configured to rest on the wedge ramp surface when the shim wedge is located between the second spacer block and the top surface of a rough opening sill in which the fenestration unit is located.

26. A method according to claim 24, wherein the fenestration unit comprises a mull joint at an intermediate position between the first end and the second end of the fenestration sill, and wherein the method further comprises attaching a mull joint spacer block along the bottom of the fenestration sill at the intermediate position before the fenestration unit is installed in a rough opening in a building structure;

and further wherein the mull joint spacer block comprises:

a base comprising a sill surface facing the bottom of the fenestration sill;

a bearing surface facing away from the bottom of the fenestration sill;

a leading ramp surface extending from the bearing surface towards the interior edge of the fenestration sill, wherein the leading ramp surface defines a leading ramp surface height measured between the sill surface of the base and the leading ramp surface that decreases when moving along the depth axis from the bearing surface towards the interior edge of the fenestration sill.

27. A method according to claim 24, wherein the method further comprises packaging the fenestration unit for delivery to a customer after attaching the first and second spacer blocks to the fenestration sill.

* * * * *